US012663016B2

(12) United States Patent
Yao et al.

(10) Patent No.: US 12,663,016 B2
(45) **Date of Patent: *Jun. 23, 2026**

(54) TURBOMACHINE AND METHOD OF ASSEMBLY

(71) Applicant: General Electric Company, Schenectady, NY (US)

(72) Inventors: Jixian Yao, Niskayuna, NY (US); Trevor Howard Wood, Clifton Park, NY (US); Kishore Ramakrishnan, Rexford, NY (US); William J. Solomon, Montgomery, OH (US); Giridhar Jothiprasad, Clifton Park, NY (US); Nicholas Joseph Kray, Mason, OH (US)

(73) Assignee: General Electric Company, Evendale, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/656,078

(22) Filed: May 6, 2024

(65) Prior Publication Data

US 2024/0288003 A1 Aug. 29, 2024

Related U.S. Application Data

(63) Continuation-in-part of application No. 18/654,444, filed on May 3, 2024, which is a continuation-in-part (Continued)

(51) Int. Cl.

| | |
|---|---|
| ***F04D 29/32*** | (2006.01) |
| ***F04D 19/00*** | (2006.01) |
| ***F04D 29/38*** | (2006.01) |

(52) U.S. Cl.

CPC ..... *F04D 29/384* (2013.01); *F04D 19/002* (2013.01)

(58) Field of Classification Search

None

See application file for complete search history.

(56) References Cited

U.S. PATENT DOCUMENTS

| | | |
|---|---|---|
| 153,456 A | 7/1874 | Paine |
| 167,209 A | 8/1875 | Paine |

(Continued)

FOREIGN PATENT DOCUMENTS

| | | |
|---|---|---|
| CH | 264094 | 9/1949 |
| CN | 1251153 | 4/2000 |

(Continued)

OTHER PUBLICATIONS

Rodrigues et al., Aerodynamic Investigation of a Composite Low-Speed Fan for UHBR Application, Journal of Turbomachinery, TURBO-20-1413, 101004, vol. 143, Issue 10, 2021, 12 pages. https://doi.org/10.1115/1.4050671.

(Continued)

*Primary Examiner* — Kayla Mccaffrey

(74) *Attorney, Agent, or Firm* — Fitch, Even, Tabin & Flannery LLP

(57) ABSTRACT

A turbomachine includes an annular casing and a fan disposed inside the annular casing and mounted for rotation about an axial centerline. The fan includes fan blades that extend radially outwardly toward the annular casing. The fan blades include a first fan blade having a fan blade airfoil body and a metal edge. The fan blade airfoil body has a leading edge. The metal edge is located at the leading edge and has a plurality of fail-fuse elements. The fan has an average chord fan width according to a first performance factor. The fan has a quantity of fan blades according to a second performance factor.

20 Claims, 10 Drawing Sheets

Related U.S. Application Data of application No. 18/511,128, filed on Nov. 16, 2023, which is a continuation of application No. 18/138,442, filed on Apr. 24, 2023, now Pat. No. 11,852,161, which is a continuation-in-part of application No. 17/986,544, filed on Nov. 14, 2022, now Pat. No. 11,661,851.

(56) References Cited

U.S. PATENT DOCUMENTS 2,037,082 A 4/1936 Martin
3,638,428 A 2/1972 Shipley
3,693,749 A * 9/1972 Motsinger ..... F02K 1/827 415/119
3,860,361 A * 1/1975 McMurtry ..... F01D 5/3053 416/127
3,892,612 A 7/1975 Carlson
4,006,999 A 2/1977 Brantley
4,022,540 A 5/1977 Young
4,108,572 A 8/1978 Platt
4,111,600 A 9/1978 Rothman
4,343,593 A 8/1982 Harris
4,453,890 A 6/1984 Brantley
4,471,020 A 9/1984 McCarthy
4,484,856 A 11/1984 Patacca
4,534,698 A 8/1985 Tomich
4,547,122 A 10/1985 Leech
4,595,340 A 6/1986 Klassen
4,698,964 A 10/1987 Glancy
4,738,594 A 4/1988 Sato
4,810,167 A 3/1989 Spoltman
4,971,641 A 11/1990 Nelson
5,013,216 A 5/1991 Bailey
5,018,271 A 5/1991 Bailey
5,049,036 A 9/1991 Bailey
5,067,876 A 11/1991 Moreman, III
5,088,665 A 2/1992 Vijgen
5,112,194 A 5/1992 More
5,123,813 A 6/1992 Przytulski
5,127,802 A 7/1992 Carlson
5,129,787 A 7/1992 Violette
5,141,400 A 8/1992 Murphy
5,160,248 A 11/1992 Clarke
5,188,505 A 2/1993 Schilling
5,222,297 A 6/1993 Graff
5,226,789 A 7/1993 Donges
5,244,345 A 9/1993 Curtis
5,269,135 A 12/1993 Vermejan
5,269,658 A 12/1993 Carlson
5,273,393 A 12/1993 Jones
5,279,109 A 1/1994 Liu
5,279,892 A 1/1994 Baldwin
5,299,914 A 4/1994 Schilling
5,336,044 A 8/1994 Forrester
5,340,280 A 8/1994 Schilling
5,344,280 A 9/1994 Langenbrunner
5,375,978 A 12/1994 Evans
5,392,514 A 2/1995 Cook
5,437,538 A 8/1995 Mitchell
5,439,353 A 8/1995 Cook
5,449,273 A 9/1995 Hertel
5,486,086 A 1/1996 Bellia
5,486,096 A 1/1996 Hertel
5,490,764 A * 2/1996 Schilling ..... F01D 5/16 416/241 B
5,516,257 A 5/1996 Kasprow
5,520,532 A 5/1996 Reinfelder
5,533,865 A 7/1996 Dassen
5,573,377 A 11/1996 Bond
5,580,217 A 12/1996 Richards
5,628,622 A 5/1997 Thore
5,634,771 A 6/1997 Howard
5,655,883 A 8/1997 Schilling
5,672,417 A 9/1997 Champenois
5,720,597 A 2/1998 Wang
5,755,558 A 5/1998 Reinfelder
5,785,498 A 7/1998 Quinn
5,823,739 A 10/1998 Van Duyn
5,836,744 A 11/1998 Zipps
5,843,354 A 12/1998 Evans
5,844,669 A 12/1998 Wang
5,908,285 A 6/1999 Graff
5,934,609 A 8/1999 Kuklinski
5,935,360 A 8/1999 Griggs
5,939,006 A 8/1999 Wang
5,965,240 A 10/1999 Blackburn
6,041,132 A 3/2000 Isaacs
6,053,696 A 4/2000 Roberts
6,113,347 A 9/2000 Forrester
6,132,857 A 10/2000 Champenois
6,190,133 B1 2/2001 Ress, Jr.
6,217,283 B1 4/2001 Ravenhall
6,290,466 B1 9/2001 Ravenhall
6,290,895 B1 9/2001 Wang
6,294,113 B1 9/2001 Woodmansee
6,413,051 B1 7/2002 Chou
6,416,280 B1 7/2002 Forrester
6,431,498 B1 8/2002 Watts
6,431,837 B1 8/2002 Velicki
6,481,971 B1 11/2002 Forrester
6,497,550 B2 12/2002 Booth
6,607,358 B2 8/2003 Finn
6,829,883 B2 12/2004 Sathianathan
6,830,436 B2 12/2004 Shibata
6,843,565 B2 1/2005 Evans
6,979,172 B1 12/2005 Mackenzie
7,018,168 B2 3/2006 Worthoff
7,153,102 B2 12/2006 Stone
7,338,250 B2 3/2008 Martindale
7,374,403 B2 5/2008 Decker et al.
7,476,086 B2 1/2009 Wadia et al.
7,507,309 B2 3/2009 Manicke
7,507,310 B2 3/2009 Manicke
7,510,778 B2 3/2009 Bernard
7,547,194 B2 6/2009 Schilling
7,575,417 B2 8/2009 Finn
7,735,833 B2 6/2010 Braun
7,736,130 B2 6/2010 Schilling
7,744,346 B2 6/2010 Schreiber
7,780,410 B2 8/2010 Kray
7,805,839 B2 10/2010 Cammer
7,837,446 B2 11/2010 McMillan
7,918,652 B2 4/2011 Fujimura
7,966,831 B2 6/2011 Kraft
8,021,102 B2 9/2011 Xie
8,038,408 B2 10/2011 Mcmillan
8,083,487 B2 12/2011 Wood
8,100,662 B2 1/2012 Schreiber
8,109,734 B2 2/2012 Backhouse
8,137,072 B2 3/2012 Kim
8,137,073 B2 3/2012 Giusti
8,146,250 B2 4/2012 Moroso
8,167,546 B2 5/2012 Shi
8,251,640 B2 8/2012 Beckford
8,408,874 B2 4/2013 Mccaffrey
8,425,178 B2 4/2013 Lenk
8,454,298 B2 6/2013 Cardarella, Jr.
8,459,955 B2 6/2013 Mcmillan
8,535,008 B2 9/2013 Dewar
8,568,101 B2 10/2013 Fujimura
8,573,936 B2 11/2013 Lafont
8,657,570 B2 2/2014 Kray
8,672,609 B2 3/2014 Lussier
8,678,743 B1 3/2014 Sheridan et al.
8,684,689 B2 4/2014 Guo
8,753,065 B2 6/2014 Sheridan et al.
8,770,938 B2 7/2014 Kreiselmaier
8,807,916 B2 8/2014 Sheridan et al.
8,814,494 B1 8/2014 Sheridan et al.
8,858,182 B2 10/2014 Schwarz
8,966,754 B2 3/2015 Xie
8,973,374 B2 3/2015 Sharma et al.
8,986,797 B2 3/2015 Xie
9,127,598 B2 9/2015 Snook

(56) References Cited

U.S. PATENT DOCUMENTS

| | | | |
|---|---|---|---|
| 9,157,327 | B2 | 10/2015 | Deal |
| 9,239,062 | B2 | 1/2016 | Lamboy |
| 9,249,666 | B2 | 2/2016 | Wood |
| 9,249,681 | B2 | 2/2016 | Robertson, Jr. |
| 9,470,097 | B2 | 10/2016 | Hodgson |
| 9,617,860 | B2 | 4/2017 | Lattanzio |
| 9,623,354 | B2 | 4/2017 | Kumar |
| 9,664,201 | B2 | 5/2017 | Dudon |
| 9,677,570 | B2 | 6/2017 | Care |
| 9,745,851 | B2 | 8/2017 | Li |
| 9,816,443 | B2 | 11/2017 | Sheridan et al. |
| 9,835,046 | B2 | 12/2017 | Reed |
| 9,982,598 | B2 | 5/2018 | Pritchard, Jr. |
| 10,012,150 | B2 | 7/2018 | Gallagher et al. |
| 10,030,522 | B2 | 7/2018 | Benson |
| 10,066,490 | B2 | 9/2018 | Yagi |
| 10,107,200 | B2 | 10/2018 | Miller |
| 10,208,676 | B2 | 2/2019 | Johnson |
| 10,247,106 | B2 | 4/2019 | Dansereau |
| 10,287,992 | B2 | 5/2019 | Tan |
| 10,337,352 | B2 | 7/2019 | Dubois |
| 10,371,047 | B2 | 8/2019 | Schwarz |
| 10,443,411 | B2 | 10/2019 | Veitch |
| 10,458,426 | B2 | 10/2019 | Wilkin, II et al. |
| 10,502,230 | B2 | 12/2019 | Anderson |
| 10,539,025 | B2 | 1/2020 | Kray |
| 10,589,475 | B2 | 3/2020 | Kray |
| 10,590,856 | B2 | 3/2020 | Howarth |
| 10,677,259 | B2 * | 6/2020 | Jain ..... F01D 5/147 |
| 10,794,281 | B2 | 10/2020 | Nestico |
| 10,794,288 | B2 | 10/2020 | Schwarz |
| 10,815,786 | B2 | 10/2020 | Hafner |
| 10,823,052 | B2 | 11/2020 | Schwarz |
| 10,830,179 | B2 | 11/2020 | Hatim |
| 10,837,290 | B2 | 11/2020 | Lee |
| 10,927,703 | B2 | 2/2021 | Kray |
| 10,934,939 | B2 | 3/2021 | Miller |
| 11,661,851 | B1 | 5/2023 | Yao et al. |
| 11,834,964 | B2 | 12/2023 | Zheng |
| 11,852,161 | B1 | 12/2023 | Yao |
| 2003/0129061 | A1 | 7/2003 | Finn |
| 2004/0146393 | A1 | 7/2004 | Evans |
| 2006/0228206 | A1 | 10/2006 | Decker |
| 2007/0243068 | A1 | 10/2007 | Wadia |
| 2008/0159868 | A1 | 7/2008 | Kray |
| 2008/0175703 | A1 * | 7/2008 | Lugg ..... F02C 7/36 415/199.5 |
| 2008/0187442 | A1 | 8/2008 | Standish |
| 2008/0253922 | A1 | 10/2008 | Trimmer |
| 2009/0013532 | A1 | 1/2009 | Wood |
| 2009/0025365 | A1 | 1/2009 | Schilling |
| 2009/0074585 | A1 | 3/2009 | Koegler |
| 2009/0074586 | A1 | 3/2009 | Le Hong |
| 2009/0136356 | A1 | 5/2009 | Beckford |
| 2009/0155065 | A1 | 6/2009 | Xie |
| 2009/0269203 | A1 | 10/2009 | Care |
| 2010/0111675 | A1 | 5/2010 | Wojtyczka |
| 2010/0150707 | A1 | 6/2010 | Jevons |
| 2010/0166562 | A1 | 7/2010 | Boyer |
| 2010/0290913 | A1 | 11/2010 | Carvalho |
| 2010/0296942 | A1 | 11/2010 | Jevons |
| 2010/0329863 | A1 | 12/2010 | Kray |
| 2011/0023301 | A1 | 2/2011 | Jones |
| 2011/0027096 | A1 | 2/2011 | Northfield |
| 2011/0033292 | A1 | 2/2011 | Huth |
| 2011/0049297 | A1 | 3/2011 | Jevons |
| 2011/0052383 | A1 | 3/2011 | Lussier |
| 2011/0052405 | A1 | 3/2011 | Parkin |
| 2011/0097213 | A1 | 4/2011 | Peretti |
| 2011/0129348 | A1 | 6/2011 | Parkin |
| 2011/0129351 | A1 | 6/2011 | Das |
| 2011/0176927 | A1 | 7/2011 | Alexander |
| 2011/0182740 | A1 | 7/2011 | Klinetob |
| 2011/0182741 | A1 | 7/2011 | Alexander |
| 2011/0182743 | A1 | 7/2011 | Naik |
| 2011/0194941 | A1 | 8/2011 | Parkin |
| 2011/0211967 | A1 | 9/2011 | Deal |
| 2011/0217160 | A1 | 9/2011 | Mcmillan |
| 2011/0217166 | A1 | 9/2011 | Mcmillan |
| 2011/0223027 | A1 | 9/2011 | Klinetob |
| 2011/0229334 | A1 | 9/2011 | Alexander |
| 2011/0286839 | A1 | 11/2011 | Wojtyczka |
| 2012/0003100 | A1 | 1/2012 | James |
| 2012/0020782 | A1 | 1/2012 | Rice |
| 2012/0021243 | A1 | 1/2012 | Kray |
| 2012/0028055 | A1 | 2/2012 | Schmidt |
| 2012/0034089 | A1 | 2/2012 | Wadewitz |
| 2012/0051935 | A1 | 3/2012 | Naik |
| 2012/0082556 | A1 | 4/2012 | Macchia |
| 2012/0082559 | A1 | 4/2012 | Guglielmin |
| 2012/0099981 | A1 | 4/2012 | Verseux |
| 2012/0100006 | A1 | 4/2012 | Merriman |
| 2012/0134774 | A1 | 5/2012 | Clark |
| 2012/0301291 | A1 | 11/2012 | Spanos |
| 2012/0301292 | A1 | 11/2012 | Deal |
| 2013/0028661 | A1 | 1/2013 | Screaton |
| 2013/0101423 | A1 | 4/2013 | Roy |
| 2013/0153456 | A1 | 6/2013 | Zhu |
| 2013/0156592 | A1 | 6/2013 | Kray |
| 2013/0164488 | A1 | 6/2013 | Wood |
| 2013/0268244 | A1 | 10/2013 | Clark |
| 2013/0276455 | A1 | 10/2013 | Fisk |
| 2013/0323065 | A1 | 12/2013 | Murooka |
| 2014/0007591 | A1 | 1/2014 | Khibnik et al. |
| 2014/0030105 | A1 | 1/2014 | Fameau |
| 2014/0193238 | A1 | 7/2014 | Sheridan |
| 2014/0212273 | A1 | 7/2014 | Le Borgne |
| 2014/0212295 | A1 | 7/2014 | Kray |
| 2014/0219805 | A1 | 8/2014 | Lamboy |
| 2014/0255152 | A1 | 9/2014 | Totten |
| 2014/0311149 | A1 | 10/2014 | Chuang |
| 2015/0016945 | A1 | 1/2015 | Kappes |
| 2015/0026980 | A1 | 1/2015 | Tellier |
| 2015/0218953 | A1 | 8/2015 | Bottome |
| 2015/0308290 | A1 | 10/2015 | Kappes |
| 2015/0361798 | A1 | 12/2015 | Cosby |
| 2015/0377030 | A1 | 12/2015 | Murdock |
| 2016/0010468 | A1 | 1/2016 | Kray |
| 2016/0069214 | A1 | 3/2016 | Engebretsen |
| 2016/0160659 | A1 | 6/2016 | Obuchi |
| 2016/0177969 | A1 | 6/2016 | Schreiber |
| 2016/0265430 | A1 | 9/2016 | Schwarz |
| 2016/0312795 | A1 | 10/2016 | Crall |
| 2016/0369703 | A1 | 12/2016 | Gallagher |
| 2018/0038243 | A1 | 2/2018 | Rambo |
| 2019/0022698 | A1 | 1/2019 | Harner |
| 2019/0072035 | A1 | 3/2019 | Peace |
| 2021/0108597 | A1 | 4/2021 | Marion |
| 2021/0269168 | A1 | 9/2021 | Shaner |
| 2021/0363923 | A1 | 11/2021 | Zysman |
| 2022/0290572 | A1 | 9/2022 | Gunasekera |
| 2023/0133871 | A1 | 5/2023 | Levisse et al. |
| 2024/0110518 | A1 | 4/2024 | Miller |
| 2024/0288000 | A1 | 8/2024 | Yao |
| 2024/0288001 | A1 | 8/2024 | Yao |
| 2024/0288002 | A1 | 8/2024 | Yao |
| 2024/0295224 | A1 | 9/2024 | Yao |
| 2024/0301889 | A1 | 9/2024 | Yao |
| 2024/0301890 | A1 | 9/2024 | Yao |
| 2024/0301891 | A1 | 9/2024 | Yao |
| 2024/0318660 | A1 | 9/2024 | Yao |
| 2024/0318661 | A1 | 9/2024 | Yao |
| 2024/0418180 | A1 | 12/2024 | Yao |
| 2024/0418181 | A1 | 12/2024 | Yao |
| 2024/0418182 | A1 | 12/2024 | Yao |
| 2024/0426316 | A1 | 12/2024 | Yao |

FOREIGN PATENT DOCUMENTS

| | | |
|---|---|---|
| CN | 1680684 | 10/2005 |
| CN | 101107424 | 1/2008 |
| CN | 101107441 | 1/2008 |
| CN | 101344014 | 1/2009 |
| CN | 101782000 | 7/2010 |

(56) References Cited

FOREIGN PATENT DOCUMENTS

| | | | |
|---|---|---|---|
| CN | 102121400 | | 7/2011 |
| CN | 102227545 | | 10/2011 |
| CN | 103124834 | | 5/2013 |
| CN | 103244350 | A | 8/2013 |
| CN | 103620165 | | 3/2014 |
| CN | 104508246 | | 4/2015 |
| CN | 105431615 | | 3/2016 |
| CN | 105814285 | | 7/2016 |
| CN | 107829958 | | 3/2018 |
| DE | 93910 | | 9/1897 |
| DE | 4206066 | | 9/1993 |
| DE | 19634296 | | 4/1997 |
| DE | 102006058415 | | 6/2008 |
| DE | 202009003490 | | 6/2009 |
| DE | 102009035689 | | 2/2011 |
| EP | 0526057 | | 2/1993 |
| EP | 0863073 | | 9/1998 |
| EP | 1085172 | | 3/2001 |
| EP | 1752610 | | 2/2007 |
| EP | 1920895 | | 5/2008 |
| EP | 1972757 | | 9/2008 |
| EP | 1992786 | | 11/2008 |
| EP | 2037082 | | 3/2009 |
| EP | 2050929 | | 4/2009 |
| EP | 2108785 | | 10/2009 |
| EP | 2159378 | | 3/2010 |
| EP | 2204535 | | 7/2010 |
| EP | 2236235 | | 10/2010 |
| EP | 2348192 | | 7/2011 |
| EP | 2458153 | | 5/2012 |
| EP | 2540974 | | 1/2013 |
| EP | 2586972 | | 5/2013 |
| EP | 2660475 | | 11/2013 |
| EP | 2811143 | | 12/2014 |
| EP | 2870346 | A1 | 5/2015 |
| EP | 2905424 | | 8/2015 |
| EP | 3015646 | | 5/2016 |
| EP | 3023588 | | 5/2016 |
| EP | 3034788 | | 6/2016 |
| EP | 2535548 | A2 * | 12/2019 |
| FR | 910191 | | 5/1946 |
| FR | 2112278 | | 6/1972 |
| FR | 2568308 | | 1/1986 |
| FR | 2994708 | | 2/2014 |
| FR | 3127024 | A1 | 3/2023 |
| FR | 3127025 | A1 | 3/2023 |
| FR | 3127269 | A1 | 3/2023 |
| FR | 3129375 | A1 | 5/2023 |
| FR | 3129428 | A1 | 5/2023 |
| FR | 3129432 | A1 | 5/2023 |
| FR | 3129436 | A1 | 5/2023 |
| FR | 3129690 | A1 | 6/2023 |
| FR | 3129970 | A1 | 6/2023 |
| FR | 3129972 | A1 | 6/2023 |
| FR | 3130313 | A1 | 6/2023 |
| FR | 3130323 | A1 | 6/2023 |
| FR | 3130747 | A1 | 6/2023 |
| FR | 3130874 | A1 | 6/2023 |
| FR | 3130875 | A1 | 6/2023 |
| FR | 3130877 | A1 | 6/2023 |
| FR | 3130879 | A1 | 6/2023 |
| FR | 3130894 | A1 | 6/2023 |
| FR | 3130895 | A1 | 6/2023 |
| FR | 3130896 | A1 | 6/2023 |
| FR | 3130897 | A1 | 6/2023 |
| FR | 3132279 | | 8/2023 |
| FR | 3132279 | A1 | 8/2023 |
| FR | 3132729 | A1 | 8/2023 |
| FR | 3132743 | A1 | 8/2023 |
| FR | 3133367 | A1 | 9/2023 |
| FR | 3133368 | A1 | 9/2023 |
| GB | 789883 | | 1/1958 |
| GB | 791563 | | 3/1958 |
| GB | 1187076 | | 4/1970 |
| GB | 1324898 | | 7/1973 |
| GB | 2105791 | | 3/1983 |
| GB | 2450139 | | 12/2008 |
| GB | 2482247 | | 1/2012 |
| GB | 2484726 | | 4/2012 |
| JP | H04232400 | | 8/1992 |
| JP | H0849698 | | 2/1996 |
| JP | 2000087898 | | 3/2000 |
| JP | 2000145402 | | 5/2000 |
| JP | 2000161296 | | 6/2000 |
| JP | 2003056304 | | 2/2003 |
| JP | 2003090300 | | 3/2003 |
| JP | 2003227302 | | 8/2003 |
| JP | 2007321643 | | 12/2007 |
| JP | 2009013984 | | 1/2009 |
| JP | 5773400 | | 9/2015 |
| SG | 174697 | | 10/2011 |
| WO | 9205341 | | 4/1992 |
| WO | 9844240 | | 10/1998 |
| WO | 03076797 | | 9/2003 |
| WO | 2006042401 | | 4/2006 |
| WO | 2008122751 | | 10/2008 |
| WO | 2010014342 | | 2/2010 |
| WO | 2010014343 | | 2/2010 |
| WO | WO2014/008051 | A1 | 1/2014 |
| WO | 2014066503 | | 5/2014 |
| WO | 2014066508 | | 5/2014 |
| WO | 2014133546 | | 9/2014 |
| WO | 2014143262 | | 9/2014 |

OTHER PUBLICATIONS

Polacsek et al., "Turbulence-airfoil Interaction Noise Reduction Using Wavy Leading Edge: An Experimental and Numerical Study", Internoise 2011, Osaka Japan, Sep. 2011.

Search Report and Written Opinion from corresponding PCT Application No. PCT/US2012/069032 dated Aug. 1, 2013.

Smith et al., "Cascade Tests of Serrated Leading Edge Blading at High Subsonic Speeds", National Aeronautics and Space Administration, pp. 1-36, Dec. 1974.

Stimpert et al., "Acoustic Test Results Ffrom a 36 inch (0.914m) Statorless Lift Fan with Serrated and Unserrated Rotor Blades" NASA, pp. 51, Jan. 1, 1975.

Unofficial English Translation of Japanese Office Action issued in connection with corresponding JP Application No. 2014549126 on Aug. 4, 2015.

* cited by examiner

TURBOMACHINE AND METHOD OF ASSEMBLY

CROSS REFERENCE TO RELATED APPLICATIONS

This application is a continuation-in-part of application U.S. Ser. No. 18/654,444, filed May 3, 2024, which is a continuation-in-part of application U.S. Ser. No. 18/511,128, filed Nov. 16, 2023, which is a continuation of application U.S. Ser. No. 18/138,442, filed on Apr. 24, 2023, now U.S. Pat. No. 11,852,161, which is a continuation-in-part of application U.S. Ser. No. 17/986,544, filed on Nov. 14, 2022, now U.S. Pat. No. 11,661,851, the contents of all of which are incorporated herein by reference in their entireties.

FIELD

The present disclosure relates generally to jet engines and, more particularly, to jet engine fans.

BACKGROUND

In one form, a gas turbine engine may include a fan and a core arranged in flow communication with one another. The core generally includes, in serial flow order, a compressor section, a combustion section, a turbine section, and an exhaust section. The fan and the core may be partially surrounded by an outer nacelle. In such approaches, the outer nacelle defines a bypass airflow passage with the core.

In operation, air is provided from the fan to an inlet of the compressor section where one or more axial compressors progressively compress the air until it reaches the combustion section. Fuel is mixed with the compressed air using one or more fuel nozzles within the combustion section and burned to provide combustion gases. The combustion gases are routed from the combustion section to the turbine section. The flow of combustion gases through the turbine section drives the turbine section and is then routed through the exhaust section to atmosphere.

BRIEF DESCRIPTION OF THE DRAWINGS

A full and enabling disclosure of the present disclosure, including the best mode thereof, directed to one of ordinary skill in the art, is set forth in the specification, with reference to the appended figures, in which.

Figure 1:
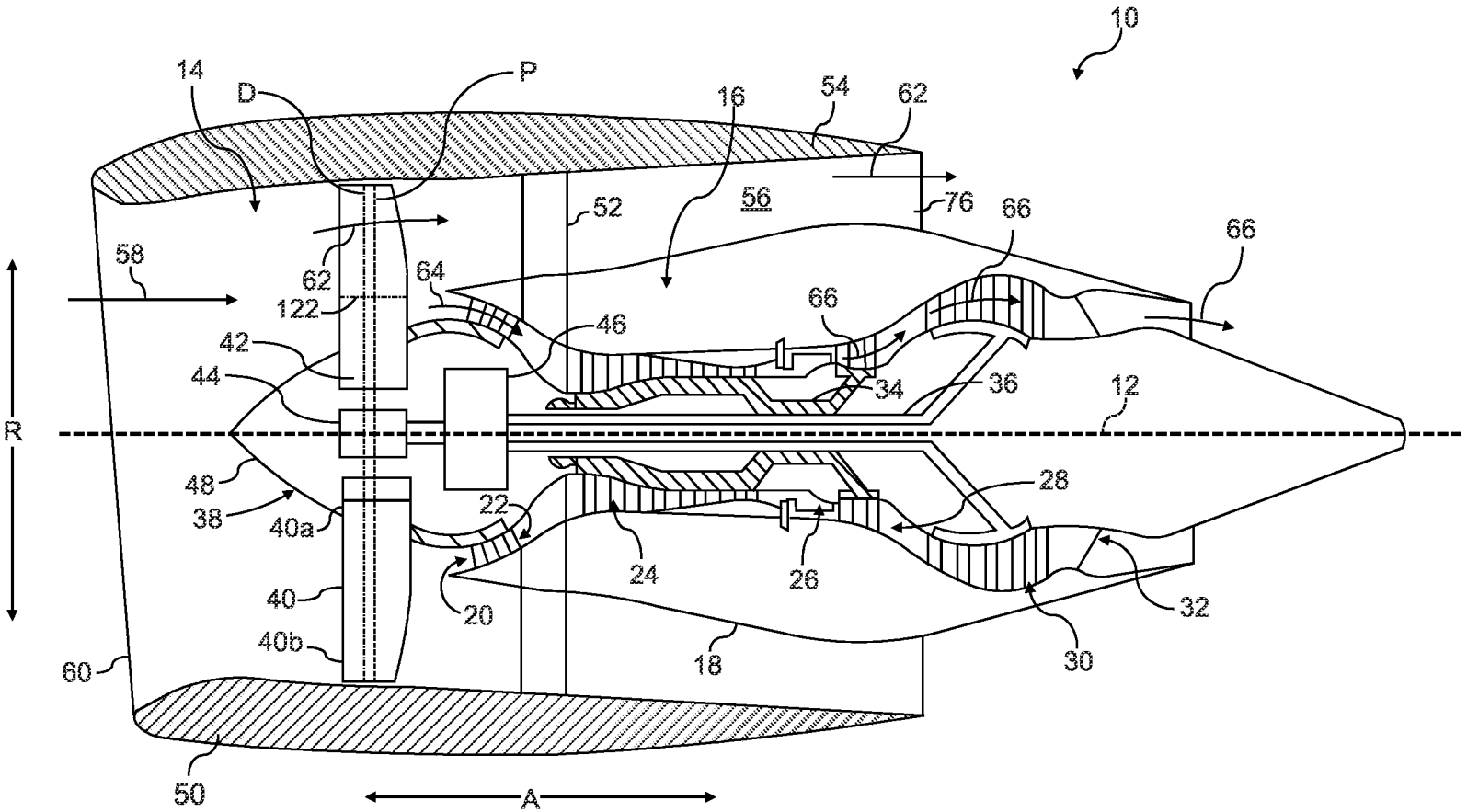
FIG. 1 is a schematic, cross-sectional view of a gas turbine engine in accordance with exemplary aspects of the present disclosure.

Elements in the figures are illustrated for simplicity and clarity and have not necessarily been drawn to scale. For example, the dimensions and/or relative positioning of some of the elements in the figures may be exaggerated relative to other elements to help to improve understanding of variations of the present disclosure. Also, common but well-understood elements that are useful or necessary in a commercially feasible embodiment are often not depicted in order to facilitate a less obstructed view of these variations of the present disclosure. Certain actions and/or steps may be described or depicted in a particular order of occurrence while those skilled in the art will understand that such specificity with respect to sequence is not actually required.

DETAILED DESCRIPTION

Aspects and advantages of the present disclosure will be set forth in part in the following description or may be learned through practice of the present disclosure.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first" and "second" may be used interchangeably to distinguish one component from another and are not intended to signify location or importance of the individual components.

The terms "upstream" and "downstream" refer to the relative direction with respect to a flow in a pathway. For example, with respect to a fluid flow, "upstream" refers to the direction from which the fluid flows, and "downstream" refers to the direction to which the fluid flows.

The terms "radial" or "radially" refer to a direction away from a common center. For example, in the overall context of a turbine engine, radial refers to a direction along a ray extending between a center longitudinal axis of the engine and an outer engine circumference.

The term "composite," as used herein is, refers to a material that includes non-metallic elements or materials. As used herein, a "composite component" or "composite material" refers to a structure or a component including any suitable composite material. A composite material may be a combination of at least two or more non-metallic elements or materials. Examples of a composite material may be, but not limited to, a polymer matrix composite (PMC), a ceramic matrix composite (CMC), a metal matrix composite (MMC), carbon fibers, a polymeric resin, a thermoplastic resin, bismaleimide (BMI) materials, polyimide materials, an epoxy resin, glass fibers, and silicon matrix materials. Composite components, such as a composite airfoil, may include several layers or plies of composite material. The layers or plies may vary in stiffness, material, and dimension to achieve the desired composite component or composite portion of a component having a predetermined weight, size, stiffness, and strength. One or more layers of adhesive may be used in forming or coupling composite components. Adhesives may include resin and phenolics, wherein the adhesive may require curing at elevated temperatures or other hardening techniques.

As used herein, "PMC" refers to a class of materials. By way of example, the PMC material is defined in part by a prepreg, which is a reinforcement material pre-impregnated with a polymer matrix material, such as thermoplastic resin. Non-limiting examples of processes for producing thermoplastic prepregs include hot melt pre-pregging in which the fiber reinforcement material is drawn through a molten bath of resin and powder pre-pregging in which a resin is deposited onto the fiber reinforcement material, by way of non-limiting example electrostatically, and then adhered to the fiber, by way of non-limiting example, in an oven or with the assistance of heated rollers. The prepregs may be in the form of unidirectional tapes or woven fabrics, which are then stacked on top of one another to create the number of stacked plies desired for the part. Multiple layers of prepreg may be stacked to the proper thickness and orientation for the composite component and then the resin is cured and solidified to render a fiber reinforced composite part. Resins for matrix materials of PMCs may be generally classified as thermosets or thermoplastics. Thermoplastic resins are generally categorized as polymers that may be repeatedly softened and flowed when heated and hardened when sufficiently cooled due to physical rather than chemical changes. Notable example classes of thermoplastic resins include nylons, thermoplastic polyesters, polyaryletherketones, and polycarbonate resins. Specific example of high performance thermoplastic resins that have been contemplated for use in aerospace applications include, polyetheretherketone (PEEK), polyetherketoneketone (PEKK), polyetherimide (PEI), polyaryletherketone (PAEK), and polyphenylene sulfide (PPS). In contrast, once fully cured into a hard rigid solid, thermoset resins do not undergo significant softening when heated, but instead thermally decompose when sufficiently heated. Notable examples of thermoset resins include epoxy, bismaleimide (BMI), and polyimide resins.

Instead of using a prepreg, in another non-limiting example, with the use of thermoplastic polymers, it is possible to utilize a woven fabric. Woven fabric may include, but is not limited to, dry carbon fibers woven together with thermoplastic polymer fibers or filaments. Non-prepreg braided architectures may be made in a similar fashion. With this approach, it is possible to tailor the fiber volume of the part by dictating the relative concentrations of the thermoplastic fibers and reinforcement fibers that have been woven or braided together. Additionally, different types of reinforcement fibers may be braided or woven together in various concentrations to tailor the properties of the part. For example, glass fibers, carbon fibers, and thermoplastic fibers could all be woven together in various concentrations to tailor the properties of the part. The carbon fibers provide the strength of the system, the glass fibers may be incorporated to enhance the impact properties, which is a design characteristic for parts located near the inlet of the engine, and the thermoplastic fibers provide the binding for the reinforcement fibers.

In yet another non-limiting example, resin transfer molding (RTM) may be used to form at least a portion of a composite component. Generally, RTM includes the application of dry fibers or matrix material to a mold or cavity. The dry fibers or matrix material may include prepreg, braided material, woven material, or any combination thereof.

Resin may be pumped into or otherwise provided to the mold or cavity to impregnate the dry fibers or matrix material. The combination of the impregnated fibers or matrix material and the resin are then cured and removed from the mold. When removed from the mold, the composite component may require post-curing processing.

It is contemplated that RTM may be a vacuum assisted process. That is, the air from the cavity or mold may be removed and replaced by the resin prior to heating or curing. It is further contemplated that the placement of the dry fibers or matrix material may be manual or automated.

The dry fibers or matrix material may be contoured to shape the composite component or direct the resin. Optionally, additional layers or reinforcing layers of material differing from the dry fiber or matrix material may also be included or added prior to heating or curing.

The singular forms "a," "an," and "the" include plural references unless the context clearly dictates otherwise.

The inventors have sought to maximize efficiency of turbine engines during in-flight propulsion of an aircraft, and correspondingly reduce fuel consumption. In particular, the inventors were focused on how the fan of a ducted turbine engine may be improved. The inventors, in consideration of several different engine architectures proposed, considered how the fan module would need to change to achieve mission requirements, and/or how the fan module could improve upon an existing engine efficiency and/or fuel consumption. The inventors looked at several engine architectures, then determined how the number of fan blades utilized with a fan, average chord width of the fan blades, diameter of the fan blade, fan pressure ratio, fan tip speed, and hub-to-tip ratio affect engine efficiency and/or fuel consumption.

The inventors found that in some engines, an excess number of fan blades may add unnecessary cost to the engine design without appreciable benefit, and may also add unnecessary weight to an aircraft, thereby reducing overall fuel efficiency (e.g., due to increased fuel burn). A reduction in fan blade quantity, however, was found to potentially lead to a reduction in total fan blade area desired for efficient propulsion, fan aeromechanical stability and operability, etc. The inventors considered increasing the width or fan chord of the fan blades to achieve a desired fan blade area with a lower fan blade count. Such considerations were found to be of particular interest when the engine had a higher bypass ratio (i.e., lower fan pressure ratio), and when the engine had a lower blade tip speed.

The determination of the fan blade count and average fan chord for achieving a desired efficiency often required a time consuming, iterative process. As explained in greater detail below, after evaluation of numerous turbine engine architectures having different fan blade counts and average fan chords, it was found, unexpectedly, that there exist certain relationships between a fan or fan blade diameter, a fan pressure ratio, and a redline corrected fan tip Mach number of the turbine engine that identify an average fan chord needed to produce improved results in terms of engine efficiency. It was further found, unexpectedly, that there exist certain relationships between turbine engine parameters including a hub-to-tip ratio of the fan, a fan pressure ratio, and a redline corrected fan tip Mach number of the turbine engine that identify a fan blade count needed to produce improved results in terms of engine efficiency.

Various aspects of the present disclosure describe aspects of an aircraft turbine engine characterized in part by an increased average fan chord width and a reduced blade count, which are believed to result in an improved engine aerodynamic efficiency and/or improved fuel efficiency. According to the disclosure, a turbomachine for powering an aircraft in flight comprises an annular casing and a fan disposed inside the annular casing and mounted for rotation about an axial centerline, the fan including fan blades that extend radially outwardly toward the annular casing.

Reference will now be made in detail to embodiments of the disclosure, one or more examples of which are illustrated in the accompanying drawings, which are incorporated in and constitute a part of this specification, illustrate embodiments of the disclosure and, together with the description, serve to explain the principles of the disclosure. The detailed description uses numerical and letter designations to refer to features in the drawings. Like or similar designations in the drawings and description have been used to refer to like or similar parts of the disclosure.

Referring now to the drawings, wherein identical numerals indicate the same elements throughout the figures, FIG. 1 is a schematic, cross-sectional view of a turbomachine, more specifically a gas turbine engine 10, in accordance with an exemplary embodiment of the present disclosure. More particularly, for the embodiment of FIG. 1, the gas turbine engine 10 is a high-bypass gas turbine engine. As shown in FIG. 1, the gas turbine engine 10 defines an axial direction A (extending parallel to a longitudinal centerline 12 provided for reference) and a radial direction R. In general, the gas turbine engine 10 includes a fan section 14 and a core turbine engine 16 disposed downstream from the fan section 14.

The exemplary core turbine engine 16 depicted generally includes a substantially tubular outer casing 18 that defines an annular inlet 20. The outer casing 18 encases, in serial flow relationship, a compressor section including a booster or low pressure (LP) compressor 22 and a high pressure (HP) compressor 24; a combustion section 26; a turbine section including a high pressure (HP) turbine 28 and a low pressure (LP) turbine 30; and a jet exhaust nozzle 32. A high pressure (HP) shaft or spool 34 drivingly connects the HP turbine 28 to the HP compressor 24. A low pressure (LP) shaft or spool 36 drivingly connects the LP turbine 30 to the LP compressor 22.

Fan blades 40 extend outwardly from disk 42 generally along the radial direction R. For the embodiment depicted, the fan section 14 includes a variable pitch fan 38 having a plurality of fan blades 40 coupled to a disk 42 in a spaced apart manner. One or more of the fan blades 40 may rotatable relative to the disk 42 about a pitch axis P by virtue of the fan blades 40 being operatively coupled to a suitable actuator 44 configured to vary the pitch of the fan blades 40, typically collectively in unison. In some approaches, the fan is a fixed pitch fan and actuator 44 is not present. The fan blades 40, disk 42, and actuator 44 may be together rotatable about the longitudinal centerline 12 by low pressure spool 36 across a power gear box 46. The power gear box 46 includes a plurality of gears for stepping down the rotational speed of the low pressure spool 36 to a more efficient rotational fan speed. In some approaches, the low pressure spool 36 may directly drive the fan without power gear box 46.

The power gear box 46 may include a plurality of gears, including an input and an output, and may also include one or more intermediate gears disposed between and/or interconnecting the input and the output. The input may comprise a first rotational speed and the output may have a second rotational speed. In some examples, a gear ratio of the first rotational speed to the second rotational speed is equal to or greater than 3.2 and equal to or less than 5.0. The power gear box 46 may comprise various types and/or configurations. In some examples, the power gear box 46 is a single-stage gear box. In other examples, the power gear box 46 is a multi-stage gear box. In some examples, the power gear box 46 is an epicyclic gearbox. In some examples, the power gear box 46 is a non-epicyclic gear box (e.g., a compound gearbox). More particularly, in some instances, the power gear box 46 is an epicyclic gear box configured in a star gear configuration. Star gear configurations comprise a sun gear, a plurality of star gears (which may also be referred to as "planet gears"), and a ring gear. The sun gear is the input and is coupled to the power turbine (e.g., the low-pressure turbine) such that the sun gear and the power turbine rotate at the same rotational speed. The star gears are disposed between and interconnect the sun gear and the ring gear. The star gears are rotatably coupled to a fixed carrier. As such, the star gears may rotate about their respective axes but cannot collectively orbit relative to the sun gear or the ring gear. As another example, the power gear box 46 is an epicyclic gear box configured in a planet gear configuration. Planet gear configurations comprise a sun gear, a plurality of planet gears, and a ring gear. The sun gear is the input and is coupled to the power turbine. The planet gears are disposed between and interconnect the sun gear and the ring gear. The planet gears are rotatably coupled to a rotatable carrier. As such, the planet gears may rotate about their respective axes and also collectively rotate together with the carrier relative to the sun gear and the ring gear. The carrier is the output and is coupled to the fan assembly. The ring gear is fixed from rotation.

Referring still to the exemplary embodiment of FIG. 1, the disk 42 is covered by rotatable front hub 48 aerodynamically contoured to promote an airflow through the plurality of fan blades 40. Additionally, the exemplary fan section 14 includes an annular fan casing or outer nacelle 50 that circumferentially surrounds the variable pitch fan 38 and/or at least a portion of the core turbine engine 16. It should be appreciated that the outer nacelle 50 may be configured to be supported relative to the core turbine engine 16 by a plurality of circumferentially spaced outlet guide vanes 52. Moreover, a downstream section 54 of the outer nacelle 50 may extend over an outer portion of the core turbine engine 16 so as to define a bypass airflow passage 56 therebetween.

During operation of the gas turbine engine 10, a volume of air 58 enters the gas turbine engine 10 through an associated inlet 60 of the outer nacelle 50 and/or fan section 14. As the volume of air 58 passes across the fan blades 40, a first portion 62 of the air 58, as indicated by arrow 62, is directed or routed into the bypass airflow passage 56 and a second portion 64 of the air 58, as indicated by arrow 64, is directed or routed into the LP compressor 22. The ratio between the first portion 62 of air 58 and the second portion 64 of air 58 is commonly known as a bypass ratio. The pressure of the second portion 64 of air 58 is then increased as it is routed through the HP compressor 24 and into the combustion section 26, where it is mixed with fuel and burned to provide combustion gases 66. Subsequently, the combustion gases 66 are routed through the HP turbine 28 and the LP turbine 30, where a portion of thermal and/or kinetic energy from the combustion gases 66 is extracted.

The combustion gases 66 are then routed through the jet exhaust nozzle 32 of the core turbine engine 16 to provide propulsive thrust. Simultaneously, the pressure of the first portion 62 of air 58 is substantially increased as the first portion 62 of air 58 is routed through the bypass airflow passage 56 before it is exhausted from a fan nozzle exhaust section 76 of the gas turbine engine 10, also providing propulsive thrust.

It should be appreciated, however, that the gas turbine engine 10 depicted in FIG. 1 is by way of example only, and that in other exemplary embodiments, aspects of the present disclosure may additionally, or alternatively, be applied to any other suitable gas turbine engine. For example, in other exemplary embodiments, the gas turbine engine 10 may instead be any other suitable aeronautical gas turbine engine, such as a turbojet engine, turboshaft engine, turboprop engine, etc. Additionally, in still other exemplary embodiments, the gas turbine engine 10 may include or be operably connected to any other suitable accessory systems. Additionally, or alternatively, the exemplary gas turbine engine 10 may not include or be operably connected to one or more of the accessory systems discussed above.

The fan blades 40 of the gas turbine engine 10 may be made from a PMC material with metal leading edges to protect the airfoil from foreign objects, such as bird strikes. A polymer matrix composite (PMC) material for the airfoil may be more durable and/or exhibit improved performance when the airfoil is subjected to flutter effects during operation. In some embodiments, engines with fewer fan blades (e.g., less than 25 fan blades) and wider chords (c), such as engines having a blade count (BC) from 14 and 18, or 16 to 20 fan blades and ratios of chord to diameter (c/D) of greater than 0.17, or greater than 0.19, and less than 0.3 (e.g., less than 0.21) have the fan blade airfoil made from a PMC material with metal leading edge.

Figure 2:
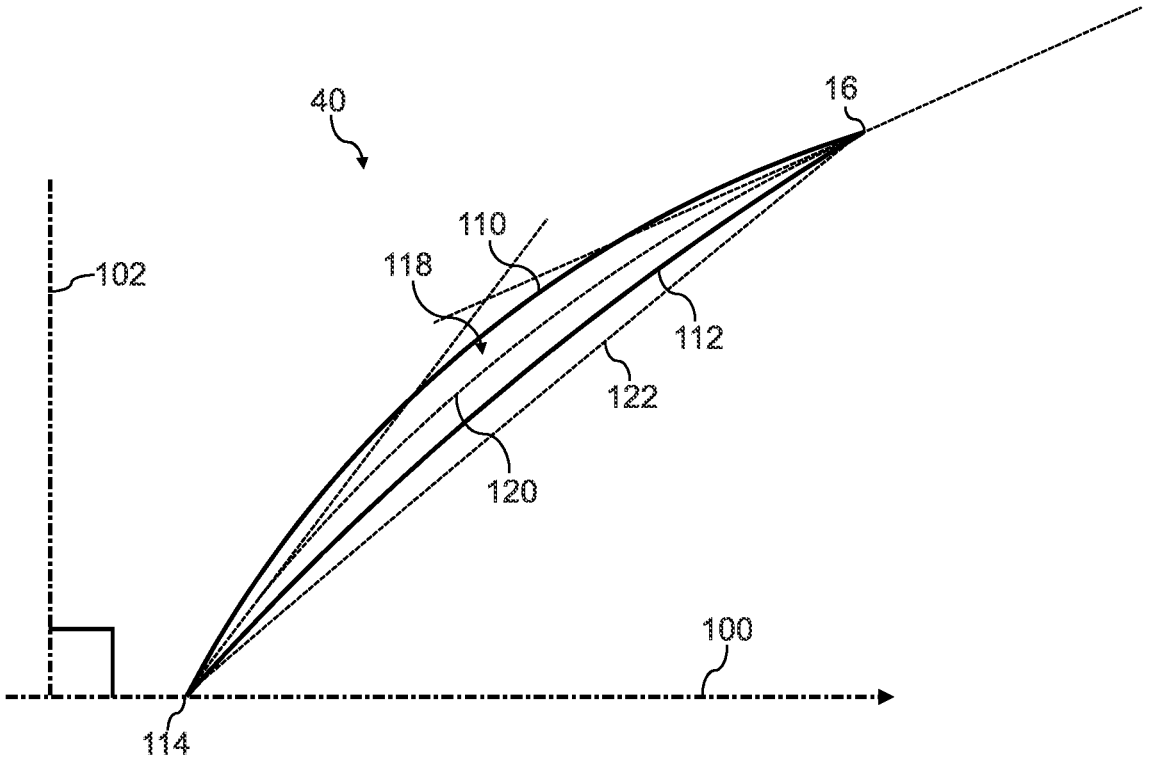
FIG. 2 is a sectional view of a fan blade in accordance with exemplary aspects of the present disclosure.

FIG. 2 is a sectional view of a fan blade 40 viewed radially (e.g., towards the rotation axis). A first axis 100 is parallel to the axial direction A of FIG. 1, and a second axis 102 is parallel to the circumferential direction θ.

Fan blade 40 includes a low-pressure surface 110 and a high-pressure surface 112 opposite the low-pressure surface 110 that each extend between a proximal end 40*a* and a distal end 40*b* of the fan blade 40 (shown in FIG. 1). Fan blade 40 further includes a leading edge 114 and a trailing edge 116.

The low-pressure surface 110, high-pressure surface 112, leading edge 114, and trailing edge 116 form a profile 118 of the fan blade 40. The profile 118 defines a mean camber 120 that extends from the leading edge 114 to the trailing edge 116 and that is equidistant from the low-pressure surface 110 and the high-pressure surface 112.

The profile 118 further defines a local chord 122 (relative to a specific cross section through the blade) that represents a straight-line distance from the leading edge 114 to the trailing edge 116.

In some approaches, a fan blade 40 may have a profile 118 that varies along a radial height of the fan blade 40 between the proximal end 40*a* and the distal end 40*b*. For example, in some fan blade designs, a distance between the leading edge 114 and the trailing edge 116 may be greater at the proximal end 40*a* of the fan blade 40 than at the distal end 40*b*. As such, the length of the local chord 122 may vary along the radial height of the fan blade 40. In this way, an average chord line length may be derived for the fan blade that accounts for the variation in lengths of the local chord 122 along the radial height of the fan blade 40.

As mentioned earlier, the inventors have discovered relationships between timescales that include a fan pressure ratio, fan diameter, and corrected fan tip Mach number during the course of improving upon the fan module portion of various engine architectures. More particularly, and as discussed in greater detail below, the inventors have discovered relationships between ratio of axial flow timescales to rotation timescales, and suitable parameters for implementing those relationships with an engine.

The aircraft turbine engine architectures developed by the inventors include as major components a fan module and an engine core. The core includes one or more compressor stages and turbine stages. Compressor stages typically include high pressure and low pressure compressor stages, and turbines similarly include high and low pressure stages. The fan module that provides for an improved efficiency is not independent of these other parts of the engine, because there is always a trade benefit when one part is improved or modified. Improved efficiency brought by the fan may be in terms of a reduction in weight, lower installed drag, load balancing or management (dynamic or static loading), aerodynamic efficiency through the fan duct/interaction of fan to output guide vanes, and other factors. In an effort to improve upon what the fan may deliver (positive benefit of fan design) there often times need to be sacrifices in other parts of the engine (negative benefit of fan design). Or the benefits of a new fan design when viewed independent of a particular core design or airframe requirement, often times requires revision or is unrealistic given the impact that such a fan design will have on other parts of the engine, e.g., compressor operating margin, balance of a fan and output guide vanes (OGV) along with a power gearbox, and location of a low pressure compressor (packaging impacts). The teachings described herein are also applicable to other engine architectures such as electrically-driven fans (which may or may not include a turbine) and hybrid electrically-driven fans (e.g., distributed electric propulsion systems in which a gas turbine drives multiple fans).

The inventors, proceeding in the manner of designing improved fan modules, accounting for the trade-offs between fan module improvements and other potentially negative or limitations on fan module design, unexpectedly found certain relationships that define an improved fan design, now described in detail.

In one aspect, the inventors have discovered a relationship between an average fan chord "c", a fan diameter "D" (e.g., a tip-to-tip dimension of the fan), a fan pressure ratio "FPR" of a fan, and a corrected redline fan tip Mach number "$M_{tip,c}^{(RL)}$," according to the below relationship, referred to herein as the First Performance Factor ("FPF") for a fan module:

$$FPF = \left[\frac{c}{0.15 \cdot D}\right] / \left[\left[\frac{\sqrt{FPR-1}}{\sqrt{0.4}}\right] / M_{tip,c}^{(RL)}\right] - 1.23 \quad (1)$$

$$m_1 \cdot \left[M_{tip,c}^{(RL)} - 1.1\right] + 6 > FPF > m_1 \cdot \left[M_{tip,c}^{(RL)} - 1.1\right] + \Delta y_1 \quad (2)$$

The ratio of average fan chord "c" to fan diameter "D" is a nondimensionalized chord width ratio greater than 0.1 (e.g., greater than 0.15, greater than 0.17, or greater than 0.19), and less than 0.3 (e.g., less than 0.21).

As used herein, the "fan pressure ratio" (FPR) refers to a ratio of a stagnation pressure immediately downstream of the plurality of outlet guide vanes 52 during operation of the fan 38 to a stagnation pressure immediately upstream of the plurality of fan blades 40 during the operation of the fan 38. The "$\sqrt{FPR-1}$" portion of the average fan chord relationship may be utilized as a surrogate for referencing a proportionality to the increase in axial flow velocity through the fan. The fan pressure ratio is greater than 1.2 (e.g., greater than 1.3), and less than 1.5 (e.g., less than 1.45, less than 1.42, or less than 1.4).

As used herein, "$M_{tip,c}^{(RL)}$" is a corrected fan tip Mach number at redline (e.g., maximum permissible rotational speed of the fan at a redline shaft speed, which is either directly coupled to the fan or through a reduction gearbox). "Fan tip speed" refers to a linear speed of an outer tip of a fan blade 40 during operation of the fan 38. "Corrected fan tip speed" (referred to as "$U_{tip,c}$") may be provided, for example, as ft/sec divided by an industry standard temperature correction. In an example approach, $U_{tip,c}$ may be less than 1,500 ft/sec (e.g., less than 1,250 ft/sec or less than 1,100 ft/sec), and greater than 500 ft/sec. "Corrected fan tip Mach number" refers to a nondimensionalized value obtained by dividing $U_{tip,c}$ by the generally accepted speed of sound at standard day sea level atmospheric conditions (i.e., 1,116.45 ft/sec). As such, $M_{tip,c}^{(RL)}$ may be less than 1.34 (e.g., less than 1.12 or less than 0.99), and greater than 0.45.

FPF, as defined in (1), may be thought of as representing a ratio of speeds. When considered with the normalized chord width "c/D," FPF may be thought of as a correlation of timescales of the blade rotation with the time taken for a flow particle to traverse a fan average chord length when the engine is operating at static conditions.

Figure 3:
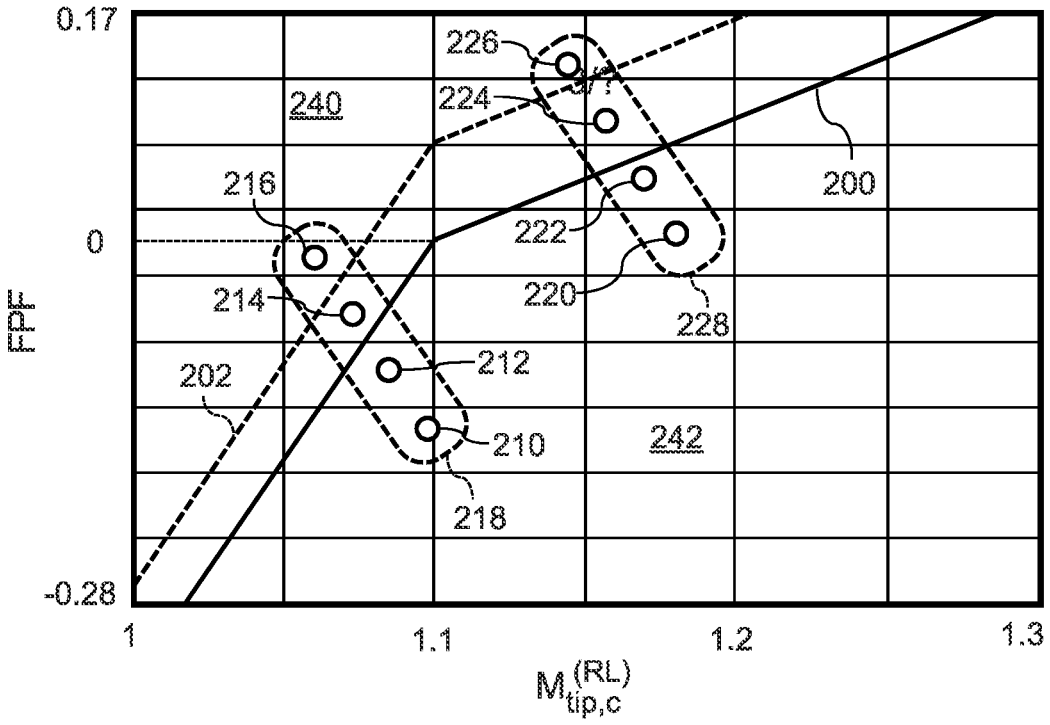
FIG. 3 shows first example engines arranged on a first plot in accordance with a first performance factor for a fan module according to the present disclosure.

Referring to the inequality defined in (2) and to the plot of FIG. 3, example engine embodiments are shown having unique FPF values and corresponding redline corrected fan tip Mach number $(M_{tip,c}^{(RL)})$. FPF increases in value along the Y-axis, while the X-axis represents left-to-right increasing redline corrected fan tip Mach number $(M_{tip,c}^{(RL)})$. FIG. 3 also shows a first line 200 and a second line 202 that is offset from the first line 200 along the Y-axis. The first and second lines 200, 202 are defined by the "$m_1 \cdot [M_{tip,c}^{(RL)} - 1.1] + \Delta y_1$" portion of inequality (2). As used herein, "$m_1$" refers to a slope of a line 200, 202, "1.1" refers to a reference corrected redline tip Mach number at which Y-intercept is defined in the FPF, and $\Delta y_1$ refers an offset from the Y-intercept along the Y-axis.

As shown in FIG. 3, the first and second lines 200, 202 are piecewise linear dividing curves; i.e., the first and second lines 200, 202 have different slopes "$m_1$" depending on the $M_{tip,c}^{(RL)}$ along the X-axis. More particularly, when the value of $M_{tip,c}^{(RL)}$ is equal to or greater than 1.1, the first and second lines 200, 202 have slopes "$m_1$" equal to 0.87. When the value of $M_{tip,c}^{(RL)}$ is less than 1.1, the first and second lines 200, 202 have slopes "$m_1$" equal to 3.34. While depicted as piecewise linear dividing curves, the low-speed scaling is actually nonlinear and there are advantages to lower c/D designs toward the lower portion of the plot of FIG. 3 associated with lower FPR and lower $M_{tip,c}^{(RL)}$ As discussed, $\Delta y_1$ refers an offset from the Y-intercept along the Y-axis. The $\Delta y_1$ value may be 0.0125, 0.04, 0.07, 0.1, or 0.2, or may vary between 0 and 6, 0 and 0.0125, 0.0125 and 0.04, 0.04 and 0.07, 0.07 and 0.1, 0.1 and 0.2, or a value greater than 0.2 and less than 6.

FIG. 3 shows eight example gas turbine engine embodiments, of which gas turbine engines 210, 212, 214, 216 may be referred to as low speed engine designs (as indicated by subplot area 218), and gas turbine engines 220, 222, 224, 226 may be referred to as high speed engine designs (as indicated by subplot area 228). Each of the gas turbine engines 210, 212, 214, 216, 220, 222, 224, 226 have a gear ratio in a range equal to or greater than 3.2 and less than or equal to 5.0.

As represented by the FPF, which indicates a particular fan chord relationship, the inventors discovered a limited or narrowed selection of average fan chords that uniquely take into consideration other factors associated with the fan and engine type. For instance, the inventors determined that an engine having an FPF value for a given $M_{tip,c}^{(RL)}$ value above line 200 (within plot area 240) may allow for relatively wider chord widths as compared to engines having an FPF value for a given $M_{tip,c}^{(RL)}$ value below line 200 (within plot area 242). In this way, gas turbine engines 214, 216, 224, and 226 may provide advantages over gas turbine engines 210, 212, 220, and 222, such as a reduced fan blade count (discussed in greater detail below), increased aeromechanical stability and reduced fan lift coefficient $C_L$ during takeoff of the aircraft. In some instances, such advantages may become more pronounced as FPF increases and $M_{tip,c}^{(RL)}$ value decreases (for next generation ultra-high bypass ratio engines for instance). For example, the improvement in engine performance based on the redline tip Mach number may have FPF values greater than $m_1 \cdot [M_{tip,c}^{(RL)} - 1.1] + 0.0125$, greater than $m_1 \cdot [M_{tip,c}^{(RL)} - 1.1] + 0.04$, greater than $m_1 \cdot [M_{tip,c}^{(RL)} - 1.1] + 0.07$, greater than $m_1 \cdot [M_{tip,c}^{(RL)} - 1.1] + 0.1$, or greater than $m_1 \cdot [M_{tip,c}^{(RL)} - 1.1] + 0.2$ (these other examples are schematically represented by the phantom line 202).

In another aspect, the inventors have discovered a relationship between a fan blade count "BC", a hub-to-tip ratio of a fan "HTR", a fan pressure ratio "FPR" of a fan, and a corrected redline fan tip Mach number "$M_{tip,c}^{(RL)}$" according to the below relationship, referred to herein as the Second Performance Factor ("SPF") for a fan module:

$$SPF = \frac{\sqrt{\frac{\pi}{4}(1 - HTR^2)/\left(\frac{BC}{20}\right)}}{\left(\frac{\sqrt{FPR - 1}}{\sqrt{0.4}}\right)/M_{tip,c}^{(RL)}} - 0.97 \tag{3}$$

$$m_2 \cdot \left[M_{tip,c}^{(RL)} - 1.1\right] + 1.5 > SPF > m_2 \cdot \left[M_{tip,c}^{(RL)} - 1.1\right] + \Delta y_2 \tag{4}$$

Regarding the hub-to-tip ratio "HTR," a fan blade defines a hub radius ($R_{hub}$), which is the radius of the leading edge at the hub relative to a centerline of the fan, and a tip radius ($R_{tip}$), which is the radius of the leading edge at a tip of the fan blade relative to the centerline of the fan. HTR is the ratio of the hub radius to the tip radius ($R_{hub}/R_{tip}$). The ratio is greater than 0.1 and less than 0.5 (e.g., less than 0.275, less than 0.25, or less than 0.225).

Blade count "BC" corresponds to the number of fan blades circumferentially arranged about the fan hub. The blade count is between 10 fan blades and 40 fan blades. In certain example approaches, the blade count is less than or equal to 18 fan blades (e.g., 16 or fewer fan blades).

"FPR" and "$M_{tip,c}^{(RL)}$" refer to a fan pressure ratio and a redline corrected fan tip Mach number, respectively, as discussed with respect to the average fan chord relationship above. In this way, the values of one or more of the FPR and "$M_{tip,c}^{(RL)}$" may be the same as those discussed with respect to the average fan chord relationship.

Figure 4:
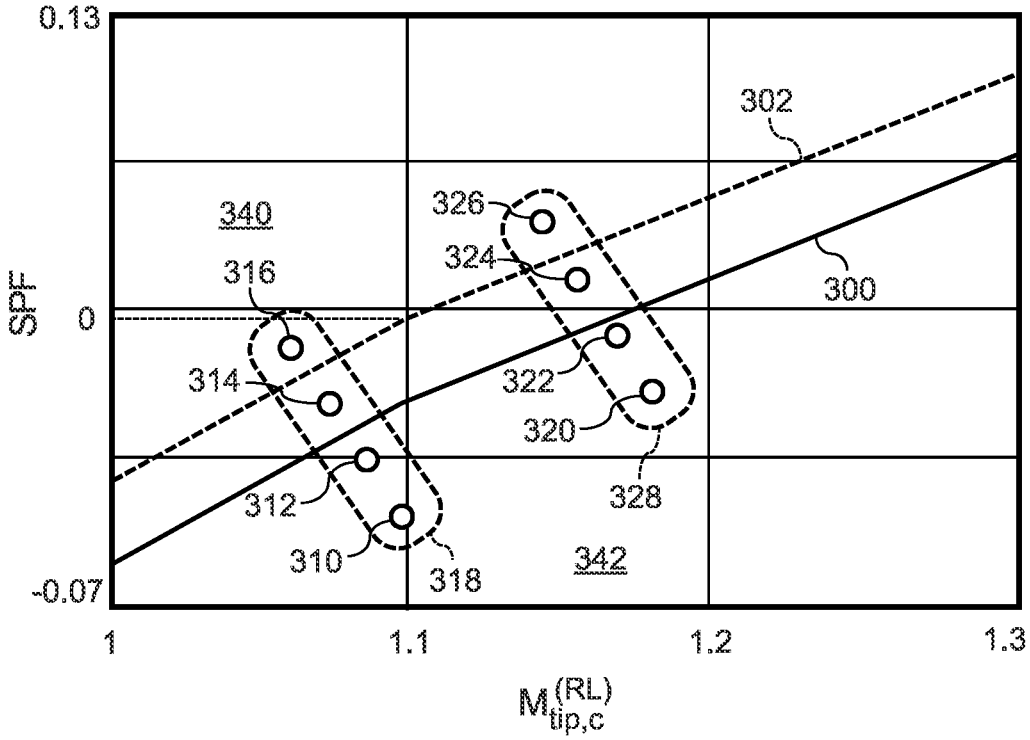
FIG. 4 shows second example engines arranged on a second plot in accordance with a second performance factor for a fan module according to the present disclosure.

Referring to the inequality defined in (4) and to the plot of FIG. 4, example engine embodiments are shown having unique SPF values and corresponding redline corrected fan tip Mach number ($M_{tip,c}^{(RL)}$). SPF increases in value along the Y-axis, while the X-axis represents left-tip,c) to-right increasing redline corrected fan tip Mach number ($M_{tip,c}^{(RL)}$). FIG. 4 also shows a first line 300 and a second line 302 that is offset from the first line 300 along the Y-axis. The first and second lines 300, 302 are defined by the "$m_2 \cdot [M_{tip,c}^{(RL)} - 1.1] + \Delta y_2$" portion of inequality (4).

As shown in FIG. 4, the first and second lines 300, 302 are piecewise linear dividing curves; i.e., the first and second lines 300, 302 have different slopes "$m_2$" depending on the $M_{tip,c}^{(RL)}$ along the X-axis. More particularly, when the value of $M_{tip,c}^{(RL)}$ is equal to or greater than 1.1, the first and second lines 300, 302 have slopes "$m_2$" equal to 0.41. When the value of $M_{tip,c}^{(RL)}$ is less than 1.1, the first and second lines 300, 302 have slopes "$m_2$" equal to 0.55.

As used herein, "$m_2$" refers to a slope of a line 300, 302, which as shown, is equal to 1. "1.1" refers to a reference corrected redline tip Mach number at which the Y-intercept is defined, and $\Delta y_2$ refers an offset from the Y-intercept along the Y-axis. The $\Delta y_2$ value may be 0.0075, 0.01, 0.02, 0.024, 0.037, 0.04, or 0.06, or may vary between 0 and 1.5, 0 and 0.0075, 0.0075 and 0.01, 0.01 and 0.2, 0.2 and 0.024, 0.024 and 0.037, 0.037 and 0.04, 0.04 and 0.6, or a value greater than 0.6 and less than 1.5.

FIG. 4 shows eight example engine embodiments, of which gas turbine engines 310, 312, 314, 316 may be referred to as low speed engine designs (as indicated by subplot area 318), and gas turbine engines 320, 322, 324, 326 may be referred to as high speed engine designs (as indicated by subplot area 328). Each of the gas turbine engines 310, 312, 314, 316, 320, 322, 324, 326 have a gear ratio a range equal to or greater than 3.2 and less than or equal to 5.0.

As represented by the SPF, which indicates a particular fan blade count relationship, the inventors discovered a limited or narrowed selection of fan blade count that uniquely take into consideration other factors associated with the fan and engine type. For instance, the inventors determined that an engine having an SPF value for a given $M_{tip,c}^{(RL)}$ value above line 300 (within plot area 340) may allow for reduced fan blade counts as compared to engines having an SPF value for a given $M_{tip,c}^{(RL)}$ value below line 300 (within plot area 342). In this way, gas turbine engines 314, 316, 324, and 326 may provide advantages over gas turbine engines 310, 312, 320, and 322, such as a reduced cost and weight. In some instances, such advantages may become more pronounced as the SPF value increases and the $M_{tip,c}^{(RL)}$ value decreases (for next generation ultra-high bypass ratio engines for instance). For example, the improvement in engine performance based on the redline tip Mach number may have SPF values greater than $m_2 \cdot [M_{tip,c}^{(RL)} - 1.1] + 0.0075$, greater than $m_2 \cdot [M_{tip,c}^{(RL)} - 1.1] + 0.01$, greater than $m_2 \cdot [M_{tip,c}^{(RL)} - 1.1] + 0.02$, greater than $m_2 \cdot [M_{tip,c}^{(RL)} - 1.1] + 0.024$, greater than $m_2 \cdot [M_{tip,c}^{(RL)} - 1.1] + 0.037$, greater than $m_2 \cdot [M_{tip,c}^{(RL)} - 1.1] + 0.04$, or greater than $m_2 \cdot [M_{tip,c}^{(RL)} - 1.1] + 0.06$ (these other examples are schematically represented by the phantom line 302).

Figure 5:
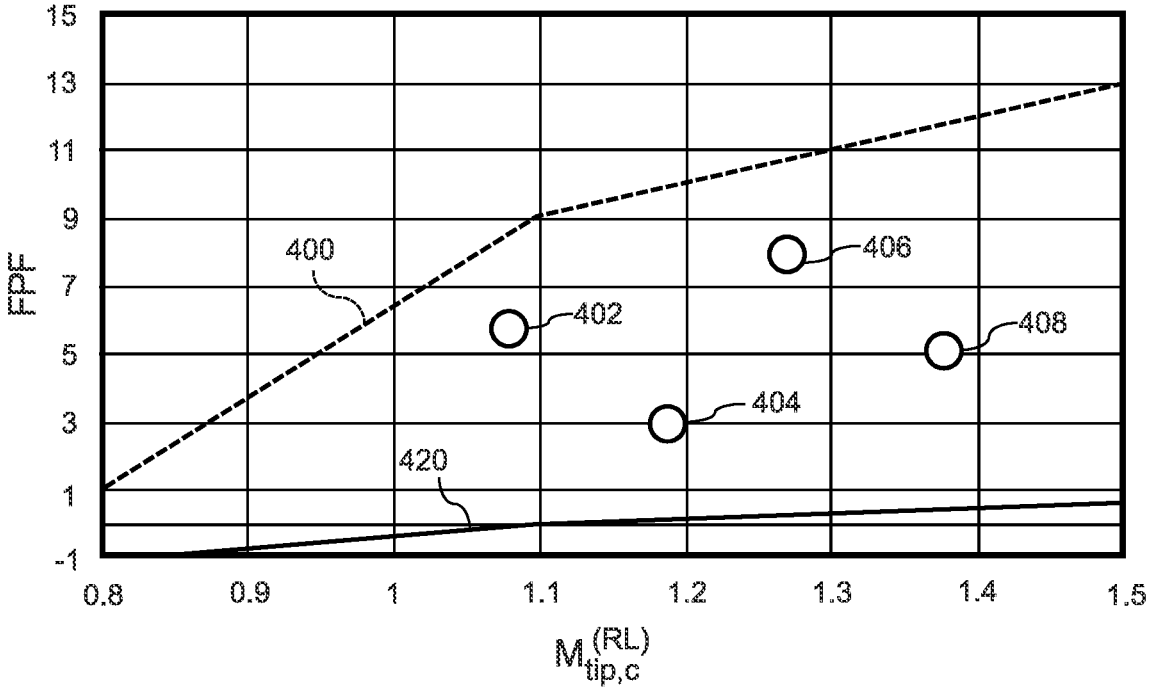
FIG. 5 shows third example gas turbine engines arranged on a third plot in accordance with the first performance factor for a fan module according to the present disclosure.

FIG. 5 shows additional example gas turbine engine embodiments 402, 404, 406, 408 having First Performance Factor (FPF) values, as similarly described herein. Line 400 is a piecewise linear dividing curve having different slopes "$m_1$" depending on the $M_{tip,c}^{(RL)}$ along the X-axis. More particularly, when the value of $M_{tip,c}^{(RL)}$ is equal to or greater than 1.1, line 400 has a slope "$m_1$" equal to 9.43. When the value of $M_{tip,c}^{(RL)}$ is less than 1.1, line 400 has a slope "$m_1$" equal to 27.02.

Line 420 corresponds to line 200 of FIG. 3 and is similarly a piecewise linear dividing curve having different slopes "$m_2$" depending on the $M_{tip,c}^{(RL)}$ along the X-axis. As with FIG. 3, when the value of $M_{tip,c}^{(RL)}$ is equal to or greater than 1.1, the line 420 has a slope "$m_2$" equal to 0.87. When the value of $M_{tip,c}^{(RL)}$ is less than 1.1, line 420 has a slope "$m_2$" equal to 3.34.

In this approach, the First Performance Factor (FPF) is as provided:

$$FPF = \left[\frac{c}{0.15 \cdot D}\right] \Big/ \left[\left[\frac{\sqrt{FPR - 1}}{\sqrt{0.4}}\right] \Big/ M_{tip,c}^{(RL)}\right] - 1.23 \tag{5}$$

$$m_1 \cdot \left[M_{tip,c}^{(RL)} - 1.1\right] + 9.14 > FPF > m_2 \cdot \left[M_{tip,c}^{(RL)} - 1.1\right] \tag{6}$$

The First Performance Factor (FPF) values may be in the range, for example, equal to or greater than −0.8 and equal to or less than 8.4, equal to or greater than 0 and equal to or less than 6, or equal to or greater than 1 and equal to or less than 2. $M_{tip,c}^{(RL)}$ values may be within a range equal to or greater than 0.8 and equal to or less than 1.5, or equal to or greater than 0.9 and equal to or less than 1.4. FPR values may be within a range equal to or greater than 1.2 and equal to or less than 1.6, equal to or greater than 1.3 and equal to or less than 1.5, or equal to or greater than 1.35 and equal to or less than 1.45.

Figure 6:
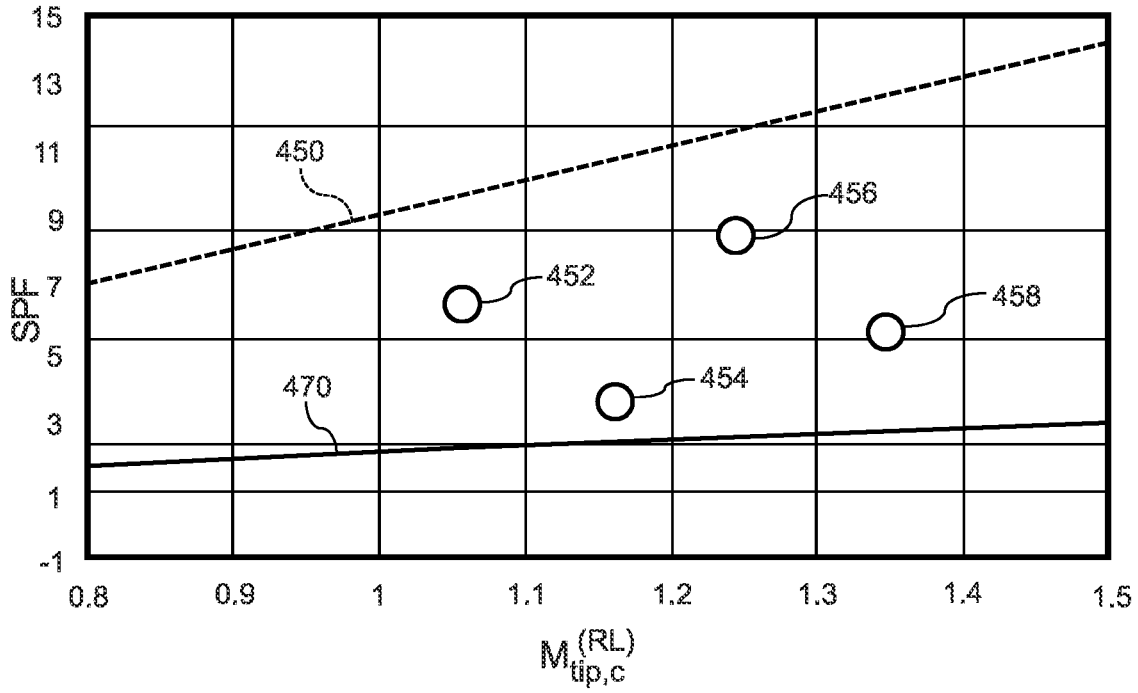
FIG. 6 shows fourth example gas turbine engines arranged on a fourth plot in accordance with the second performance factor for a fan module according to the present disclosure.

FIG. 6 shows additional example gas turbine engine embodiments 452, 454, 456, 458 having Second Performance Factor (SPF) values, as similarly described herein. Line 450 is a linear curve having slope "$m_3$" of 3.17. Line 470 corresponds to line 300 of FIG. 4 and is similarly a piecewise linear dividing curve having different slopes "$m_4$" depending on the $M_{tip,c}^{(RL)}$ along the X-axis. More particularly, when the value of $M_{tip,c}^{(RL)}$ is equal to or greater than 1.1, line 470 has a slope "$m_4$" equal to 0.41. When the value of $M_{tip,c}^{(RL)}$ is less than 1.1, line 420 has a slope "$m_4$" equal to 0.55.

In this approach, the Second Performance Factor (SPF) is as provided:

$$SPF = \frac{\sqrt{\frac{\pi}{4}(1 - HTR^2)/\left(\frac{BC}{20}\right)}}{\left(\frac{\sqrt{FPR - 1}}{\sqrt{0.4}}\right)/M_{tip,c}^{(RL)}} - 0.97 \quad (7)$$

$$m_3 \cdot \left[M_{tip,c}^{(RL)} - 1.1\right] + 2.52 > SPF > m_4 \cdot \left[M_{tip,c}^{(RL)} - 1.1\right] \quad (8)$$

The Second Performance Factor (SPF) values may be in the range, for example, equal to or greater than 0.087 and equal to or less than 2.4, or equal to or greater than 1 and equal to or less than 2. $M_{tip,c}^{(RL)}$ values may be within a range equal to or greater than 0.8 and equal to or less than 1.5, or equal to or greater than 0.9 and equal to or less than 1.4. HTR values may be within a range equal to or greater than 0.2 and equal to or less than 0.4, or equal to or greater than 0.25 and equal to or less than 0.35.

The inventors have discovered a relationship between the First Performance Factor and Second Performance Factor described herein. More particularly, the inventors have discovered that engine designs achieving each of the First Performance Factor and Second Performance Factor, while maintaining relatively-constant solidity, provide improved engine performance. Blade solidity is defined as the ratio of the blade chord length to the distance of space between the blades.

Example engine parameters and corresponding First Performance Factors and Second Performance Factors are presented in Table 1 below.

TABLE 1

| Example | HTR | FPR | $M_{tip,c}^{(RL)}$ | SPF | FPF |
|---|---|---|---|---|---|
| 1 | 0.206 | 1.522 | 1.417 | 1.782 | 2.374 |
| 2 | 0.400 | 1.376 | 1.421 | 0.981 | 0.976 |
| 3 | 0.260 | 1.204 | 1.177 | 0.823 | 2.722 |
| 4 | 0.224 | 1.595 | 0.976 | 0.646 | −0.359 |
| 5 | 0.213 | 1.517 | 0.815 | 0.613 | −0.823 |
| 6 | 0.265 | 1.448 | 1.497 | 1.152 | 1.161 |
| 7 | 0.352 | 1.250 | 0.962 | 0.087 | −0.445 |
| 8 | 0.394 | 1.328 | 1.228 | 2.403 | 6.606 |
| 9 | 0.213 | 1.517 | 0.815 | 0.613 | −0.823 |
| 10 | 0.235 | 1.240 | 1.231 | 2.053 | 8.398 |

In this way, using fan parameters such as fan pressure ratios, corrected fan tip Mach number, fan diameters, and hub-to-tip ratios, the inventors discovered approaches that utilize the above-described average fan chord relationship to obtain an average chord width, and the above-described fan blade count relationship to obtain a fan blade count. These obtained constraints guide one to select fan chord width, blade count, or both suited for the particularized engine architectures and mission requirements, informed by engine-unique environments and trade-offs in design (as discussed above), which are believed to result in an improved engine.

In another aspect, the FPF and SPF may also be useful as a design tool for down-selecting, or providing a guideline for reducing the number of candidate designs for fan blade counts and average fan chords from which to design a fan module for a particular architecture. In this way, an engine architecture is improved overall by knowing, early in the design process, what constraints or limitations would be imposed by a fan module given the mission objectives.

In another aspect method of assembly is provided. The method includes mounting a fan inside an annular casing for rotation about an axial centerline. The fan including fan blades that extend radially outwardly toward the annular casing. The fan further includes an average fan chord width according to the First Performance Factor ("FPF") and/or a quantity of fan blades according to the Second Performance Factor ("SPF") discussed above.

Also disclosed herein is a metal leading edge for a fan blade that allows the metal leading edge to break apart during fan blade out events. The metal leading edge includes a nose, a pressure side edge, a suction side edge, and a notch. The nose extends from the leading edge of a fan blade. The pressure side edge and the suction side edge extend from the nose along the body of the fan blade. The notch is formed from the conjunction of the nose, the pressure side edge, and the suction side edge. The notch is adhesively bonded to the fan blade. A nose length extends from the tip of the nose to the notch. Each embodiment of the metal leading edge includes a weakening structure which weakens the metal leading edge allowing it to break during extreme loading conditions, such as a fan blade out event, reducing the damage to fan case.

The metal leading edge described herein offers advantages. The metal leading edge disclosed herein fractures during an extreme loading conditions. Aviation regulations require either the nacelle or containment case to be fully capable of containing a fan blade from flying into the aircraft's fuselage during a fan blade out event. The armoring of the nacelle or containment case must be strong enough to contain the fan blades during fan blade out events. A stronger and heavier fan blade released from the fan trunnion requires a correspondingly stronger and heavier armoring of the nacelle or containment case, which increases the weight of the aircraft. Ideally, one wants the fan blade to fracture into small pieces so that the impact into the fan case/containment case is less severe, thereby enabling a lighter fan case sufficient to contain the metal leading edge during a blade out event. The metal leading edge described herein is weakened to break into smaller pieces during a fan blade out event. A weaker metal leading edge reduces the armoring of the nacelle or containment case, reducing the weight of the engine. Additionally, a weaker metal leading edge reduces damage to trailing fans during a fan blade out event. Furthermore, metal leading edge described herein reduces fan blade outloads and unbalance.

As applied to the above relationships (1) through (4), it will be appreciated that the metal leading edge (engineered to break apart during fan blade out events, reducing a potential damage to a fan case and other components) may be integrated into the fan module contemplated by the above relationships (1) through (4) to further improve engine efficiency and fuel consumption. In particular, the fail-fuse features of the metal leading edge, as described herein, provide a significant enhancement to the relationships (1) through (4), discussed above. In particular, an ability to minimize kinetic energy during a blade release event allows for a lighter designed composite fan case, which directly impacts the net fuel burn and efficiency of the engine. Moreover, the First Performance Factor (FPF) and Second Performance Factor (SPF) parameters may be used to further reduce fuel burn by driving the fan blade design towards a lower corrected fan tip speed ($U_{c(tip)}$), which in turn allows for the selection of a lower fan chord and potentially a reduced blade count (BC). This reduction in fan chord and/or tip speed may enables the use of a lighter metal leading edge, which synergistically improves the efficiency of the engine (with FPF and SPF) by reducing the overall system weight and enhancing fuel efficiency.

Moreover, the lower corrected fan tip speed ($U_{c(tip)}$) results in decreased erosion along the metal leading edge, permitting a less structural leading-edge nose design. This reduction in structural requirements enables the development of more effective leading-edge configurations that are designed to fail upon release (e.g., the fail-fuse features). More specifically, the improved fan module designs discussed herein above may enable use of the technology described hereinbelow, whereby the fail-fuse features further reduce kinetic energies imparted to the fan case during a blade out event. Such designs contribute to lighter fan case constructions without compromising safety or performance.

Accordingly, it will be appreciated that the integration of the metal leading edge technology with the relationships discussed hereinabove (relationships (1) through (4), above) results in a fan module that offers a synergistic engine improvement in terms of engine aerodynamic efficiency, fuel efficiency, and safety. The combination of these technologies represents a significant advancement in gas turbine engine design, providing economic and environmental benefits while adhering to stringent aviation safety regulations.

Figure 7:
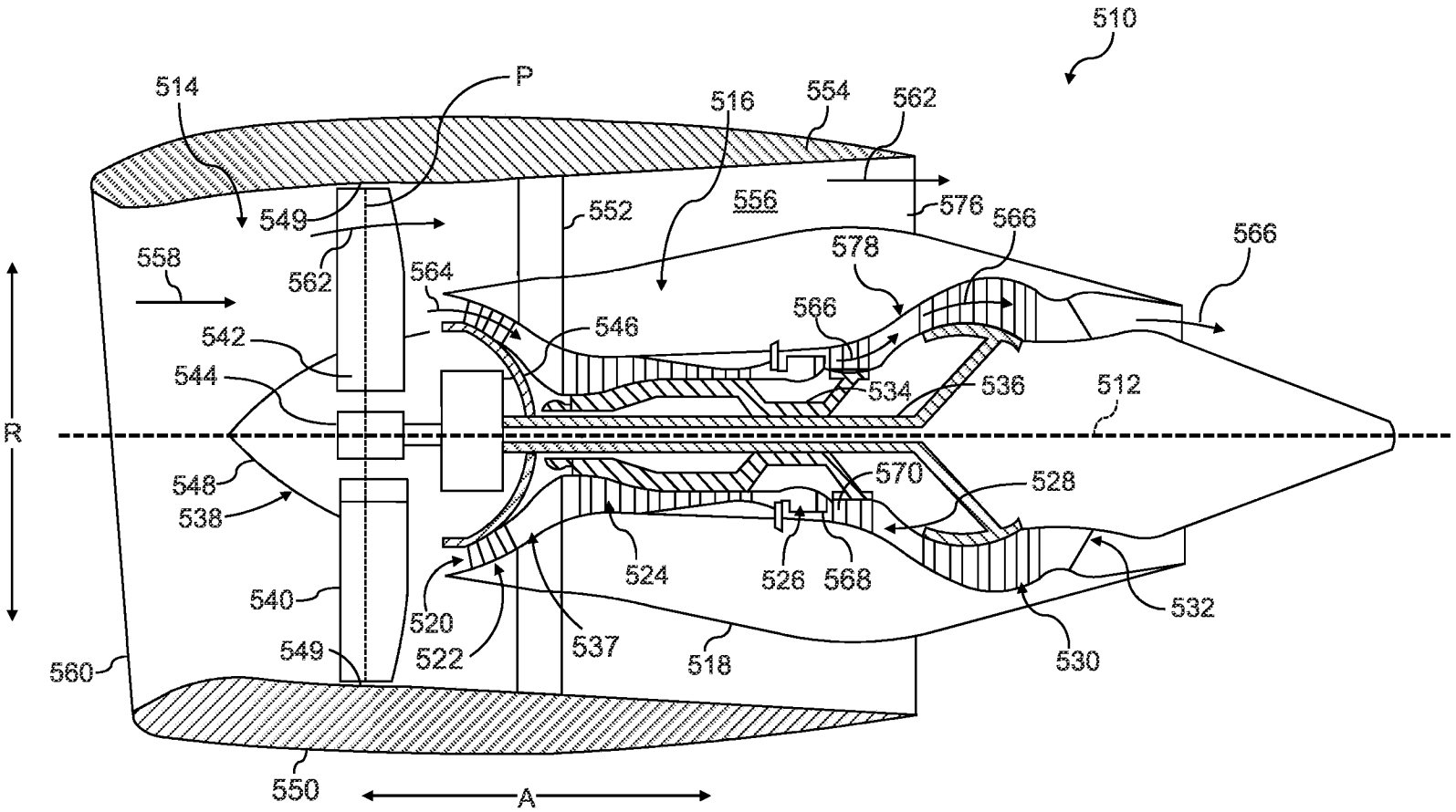
FIG. 7 is a schematic view of an exemplary gas turbine engine.

FIG. 7 is a schematic cross-sectional view of a gas turbine engine 510 in accordance with an exemplary embodiment of the present disclosure. In the exemplary embodiment, the gas turbine engine 510 is a high-bypass turbofan jet engine. As shown in FIG. 7, the gas turbine engine 510 defines an axial direction A (extending parallel to a longitudinal axis 512 provided for reference) and a radial direction R. In general, the gas turbine engine 510 includes a fan section 514 and a core turbine engine 516 disposed downstream from fan section 514.

Exemplary core turbine engine 516 depicted generally includes a substantially tubular outer casing 518 that defines an annular inlet 520. Outer casing 518 encases, in serial flow relationship, a compressor section 523 including a booster or low pressure (LP) compressor 522 and a high pressure (HP) compressor 424; a combustion section 526; a turbine section including a high pressure (HP) turbine 528 and a low pressure (LP) turbine 530; and a jet exhaust nozzle section 532. A high pressure (HP) shaft or spool 534 drivingly connects HP turbine 528 to HP compressor 524. A low pressure (LP) shaft or spool 536 drivingly connects LP turbine 530 to LP compressor 522. The compressor section 523, combustion section 526, turbine section, and nozzle section 532 together define a core air flow path 537.

For the embodiment depicted, fan section 514 includes a variable pitch fan 538 having a plurality of fan blades 540 coupled to a disk 542 in a spaced apart manner. As depicted, fan blades 540 extend outwardly from disk 542 generally along radial direction R. Each fan blade 540 is rotatable relative to disk 542 about a pitch axis P by virtue of fan blades 540 being operatively coupled to a suitable pitch change mechanism 544 configured to collectively vary the pitch of fan blades 540 in unison. Fan blades 540, disk 542, and pitch change mechanism 544 are together rotatable about the longitudinal axis 512 by LP shaft or spool 536 across a power gear box 546. Power gear box 546 includes a plurality of gears for adjusting the rotational speed of fan 538 relative to LP shaft or spool 536 to a more efficient rotational fan speed. In an alternative embodiment, fan blade 540 is a fixed pitch fan blade rather than a variable pitch fan blade.

Also, in the exemplary embodiment, disk 542 is covered by rotatable front hub 548 aerodynamically contoured to promote an airflow through plurality of fan blades 540. Additionally, exemplary fan section 514 includes an annular fan casing 549 and an outer nacelle 550 that circumferentially surrounds fan 538 and/or at least a portion of core turbine engine 516. Fan casing 549 includes an armored annular casing circumscribing fan section 514 and disposed within nacelle 550. Nacelle 550 is configured to be supported relative to core turbine engine 516 by a plurality of circumferentially-spaced outlet guide vanes 552. A downstream section 554 of nacelle 550 extends over an outer portion of core turbine engine 516 so as to define a bypass airflow passage 556 therebetween.

During operation of gas turbine engine 510, a volume of air 558 enters gas turbine engine 510 through an associated inlet 560 of nacelle 550 and/or fan section 514. As volume of air 558 passes across fan blades 540, a first portion of air 558, as indicated by arrows 562, is directed or routed into bypass airflow passage 556 and a second portion of air 558, as indicated by arrow 564, is directed or routed into core air flow path 537, or more specifically into LP compressor 522. The ratio between first portion of air 562 and second portion of air 564 is commonly known as a bypass ratio. The pressure of second portion of air 564 is then increased as it is routed through HP compressor 524 and into combustion section 526, where it is mixed with fuel and burned to provide combustion gases 566.

Combustion gases 566 are routed through HP turbine 528 where a portion of thermal and/or kinetic energy from combustion gases 566 is extracted via sequential stages of HP turbine stator vanes 568 that are coupled to outer casing 518 and HP turbine rotor blades 570 that are coupled to HP shaft or spool 534, thus causing HP shaft or spool 534 to rotate, thereby supporting operation of HP compressor 524. Combustion gases 566 are then routed through LP turbine 530 where a second portion of thermal and kinetic energy is extracted from combustion gases 566 via sequential stages of LP turbine stator vanes 572 that are coupled to outer casing 518 and LP turbine rotor blades 574 that are coupled to LP shaft or spool 536, thus causing LP shaft or spool 536 to rotate which causes power gear box 546 to rotate LP compressor 522 and/or rotation of fan 538.

Combustion gases 566 are subsequently routed through jet exhaust nozzle section 532 of core turbine engine 516 to provide propulsive thrust. Simultaneously, the pressure of first portion of air 562 is substantially increased as first portion of air 562 is routed through bypass airflow passage 556 before it is exhausted from a fan nozzle exhaust section 576 of gas turbine engine 510, also providing propulsive thrust. HP turbine 528, LP turbine 530, and jet exhaust nozzle section 532 at least partially define a hot gas path 578 for routing combustion gases 566 through core turbine engine 516.

During a fan blade out event, a fan blade of the plurality of fan blades 540 breaks loose from disk 542 and flies into nacelle 550, fan casing 549, other fan blades 540, and other parts of gas turbine engine 510. Fan casing 549 is armored to prevent a loose fan blade 540 from impacting the fuselage of the aircraft. Stronger fan blades 540 require heavier armoring for fan casing 549. Exemplary embodiments of fan blades 540 described herein are designed to break apart during extreme loading conditions, such as a fan blade out event, reducing the damage to fan casing 549, nacelle 550, other fan blades 540, and other parts of gas turbine engine 510. Accordingly, the armoring of fan casing 549 may be reduced which reduces the weight of gas turbine engine 510.

Exemplary gas turbine engine 510 depicted in FIG. 7 is by way of example only, and that in other embodiments, gas turbine engine 510 may have any other suitable configuration. It should also be appreciated, that in still other embodiments, aspects of the present disclosure may be incorporated into any other suitable gas turbine engine. For example, in other embodiments, aspects of the present disclosure may be incorporated into, e.g., a turboprop engine.

Figure 8:
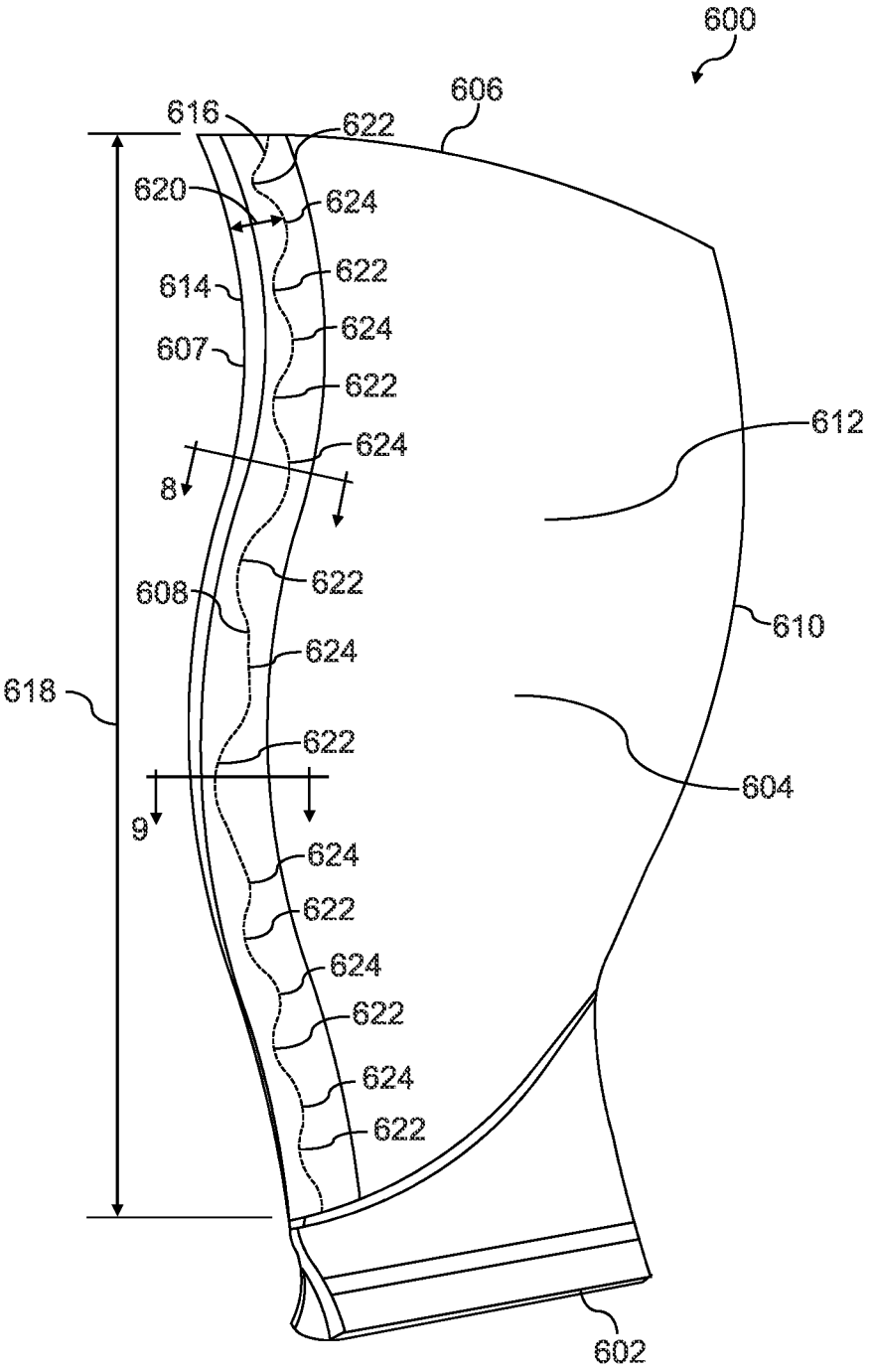
FIG. 8 is a perspective view of a fan blade that is used with the gas turbine engine shown in FIG. 7.

Referring now to FIG. 8, a fan blade 600 in accordance with an exemplary embodiment of the present disclosure is provided. The fan blade 600 may be configured in a similar manner as the exemplary fan blade 40 described above with reference to FIG. 7, and further is part of a fan having a First Performance Factor, a Second Performance Factor, or both in accordance with the disclosure herein. In such a manner, it will be appreciated that the fan blade 600 may be incorporated into a fan of a turbofan engine (such as the fan 38 of the gas turbine engine 10 of FIG. 1 and the fan 538 of FIG. 7). Accordingly, the fan blade 600 may be attached to fan disk (see, e.g., disk 42 of FIG. 1 and disk 542 of FIG. 7) and enclosed at least in part by an outer nacelle (see, e.g., outer nacelle 50 of FIG. 1 and outer nacelle 550 of FIG. 7).

As will be appreciated, during a fan blade out event, a fan blade of the plurality of fan blades breaks loose from disk and flies into the outer nacelle, a fan casing incorporated into the outer nacelle, other fan blades, and other parts of gas turbine engine. In some embodiments, the fan casing is armored to prevent a loose fan blade 600 from impacting a fuselage of the aircraft. Stronger fan blades require heavier armoring for fan casing. Exemplary embodiments of fan blades described herein are designed to break apart during extreme loading conditions, such as a fan blade out event, reducing the damage to fan casing, nacelle, other fan blades, and other parts of gas turbine engine. Accordingly, the armoring of fan casing may be reduced which reduces the weight of gas turbine engine.

The exemplary fan blade 600 of FIG. 7 includes a fan blade root 602, a fan blade body 604, a fan blade tip 606, a leading edge 607, a metal leading edge 608, and a trailing edge 610. Fan blade root 602 is operatively coupled to pitch change mechanism 544 configured to vary the pitch of fan blade 600. Fan blade body 604 extends from fan blade root 602 in radial direction R to fan blade tip 606. Fan blade body 604 includes an airfoil shaped blade metallic or composite blade. Fan blade body 604 and metal leading edge 608 include a suction side 612 and a pressure side 614. Trailing edge 610 extends from fan blade body 604 in the opposite direction of rotation of fan blade 600. Leading edge 607 extends from fan blade body 604 in the direction of rotation of fan blade 600. Metal leading edge 608 is adhesively bonded to fan blade body 604 and wraps partially around leading edge 607 forming a notch 616 (shown as a dashed line in FIG. 8) at the intersection of the suction side 612 and pressure side 614 of fan blade body 604 and the interior portion of metal leading edge 608. Notch 616 extends along a length 618 of metal leading edge 608 and includes a nose length 620 extending from leading edge 607 to notch 616. Metal leading edge 608 may be composed of composite materials or metallic materials such as, but not limited to, titanium or steel.

Metal leading edge 608 includes a plurality of fail-fuse points 622 (or fail-fuse elements) located periodically along length 618 of metal leading edge 608 and sized in a predetermined direction to break during extreme loading conditions, such as a fan blade out event, reducing the damage to fan case 549. Metal leading edge 608 also includes a plurality of non-fail-fused points 624 located periodically along length 618 of metal leading edge 608 and sized not to break during extreme loading conditions, such as a fan blade out event. The nose lengths 620 of fail-fused points 622 are shorter than the nose lengths 620 of non-fail-fuse points 624. The shorter nose lengths of fail-fuse points 622 weakens fail-fuse points 622 increasing the likelihood that metal leading edge 608 will break at those locations during extreme loading conditions, such as a fan blade out event. In an exemplary embodiment, nose length 620 may vary by length 618 according to a sinusoidal function, forming multiple fail-fuse points 622 along length 618. In another embodiment, nose length 620 may vary according to radial distance from fan blade tip 602. In another embodiment, nose length 620 may vary by step function where nose length 620 is constant at a first length for a first radial distance. Nose length 620 is then reduced to a second length for a second radial distance. Nose length 620 returns to the first length for a third radial distance. In another embodiment, nose length 620 may vary randomly along length 618, forming multiple fail-fuse points 622 along length 618.

As described above, and referring also briefly to FIG. 7, during normal operations, rotation of fan blade 600 directs air into bypass airflow passage 556 and into a core air flow path 537 through the engine inlet 520. During a fan blade out event, fan blade 600 breaks loose from disk 542 and flies into nacelle 550, fan casing, other fan blades 40, 540, 600, and other parts of gas turbine engine 10, 510. Exemplary embodiments of fan blade 600 described herein are designed to break apart at fail-fuse points 622 during extreme loading conditions, such as a fan blade out event, reducing the damage to fan casing, outer nacelle 50, 550, other fan blades 40, 540, 600, and other parts of gas turbine engine 10, 510.

Figure 9:
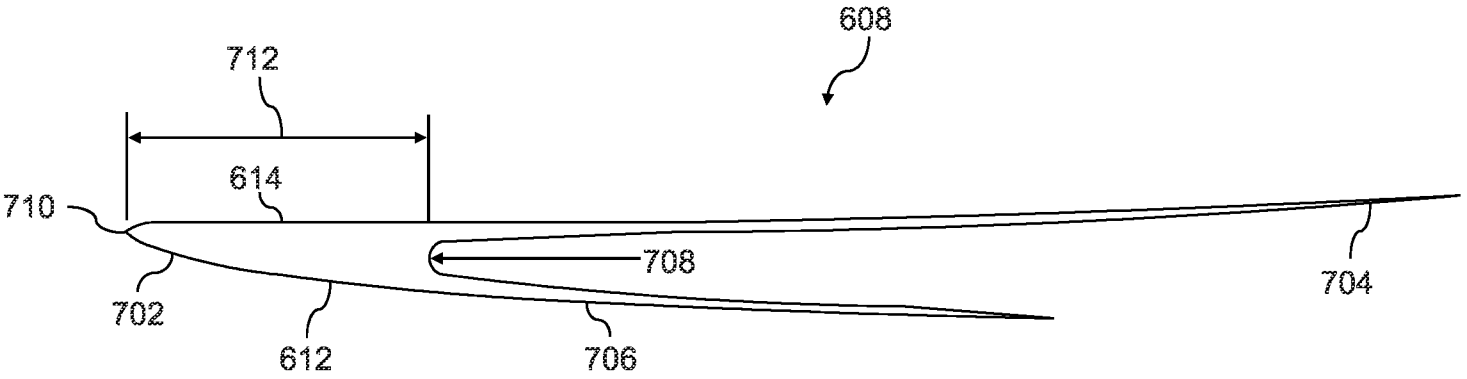
FIG. 9 is a cutaway view of a metal leading edge at a non-fail-fused location.

FIG. 9 is a cutaway view of metal leading edge 608 at a non-fail-fused point 624 along line 8-8. Metal leading edge 608 includes a nose 702, a pressure side bond edge 704, and a suction side bond edge 706. Nose 702 extends from fan blade body 604 in the direction of rotation of fan blade 600. Pressure side bond edge 704 and suction side bond edge 706 extend from nose 702 along fan blade body 604 in the opposite direction of rotation of fan blade 600. A non-fail-fused notch 708 is formed from the conjunction of nose 702, pressure side bond edge 704, and suction side bond edge 706. Nose 702 includes a nose tip 710 and a non-fail-fused nose length 712. Non-fail-fused nose length 712 extends from nose tip 710 to notch 708.

Figure 10:
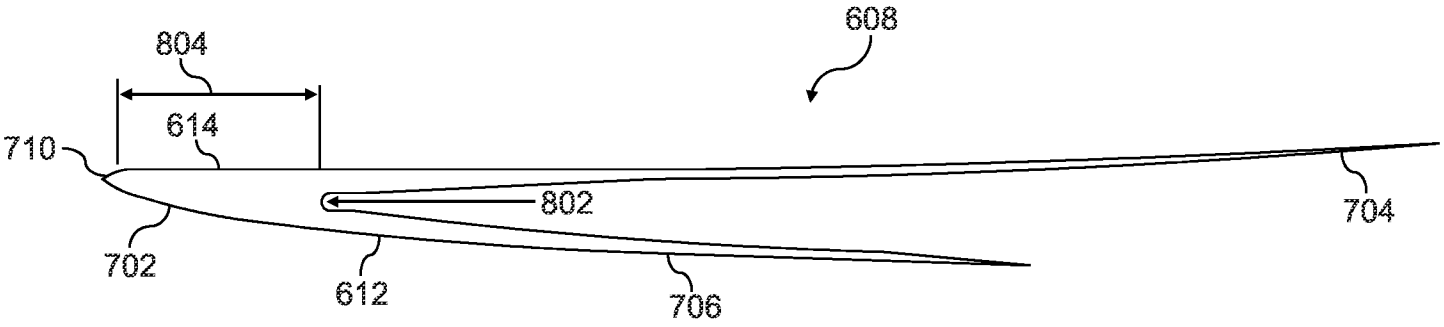
FIG. 10 is a cutaway view of a metal leading edge at a fail-fused location.

FIG. 10 is a cutaway view of metal leading edge 608 at a fail-fused point 622 along line 9-9. At fail-fuse point 622 along line 8-8, metal leading edge 608 includes a fail-fused notch 802 and a fail-fused nose length 804. Fail-fused notch 802 is milled to extend further into nose 702 than non-fail-fused notch 708 extended into nose 702. Accordingly, fail-fused nose length 804 is shorter than non-fail-fused nose length 712. A shorter fail-fuse nose length 804 weakens nose 702 at fail-fuse point 622 along line 8-8 allowing metal leading edge 608 to break during extreme loading conditions, such as a fan blade out event, reducing the damage to fan case 549. Metal leading edge 608 includes a plurality of fail-fuse points 622 to weaken metal leading edge 608 at multiple points along length 618.

Figure 11:
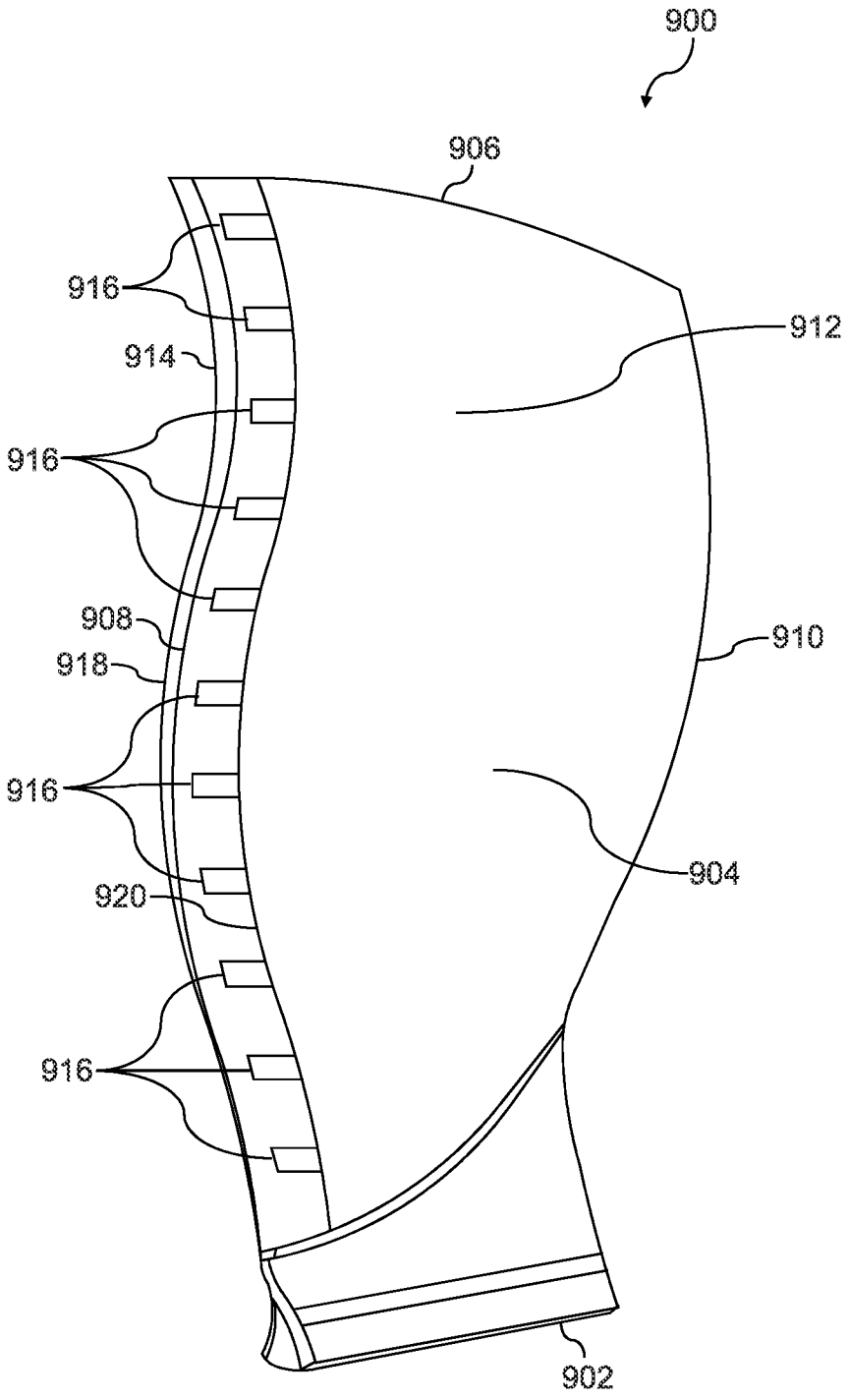
FIG. 11 is a perspective view of a notched metal leading edge.

FIG. 11 is a perspective view of a fan blade 900. Fan blade 900 includes a fan blade root 902, a fan blade body 904, a fan blade tip 906, a metal leading edge 908, and a trailing edge 910. Fan blade body 904 extends from fan blade root 902 in radial direction R to fan blade tip 906 and is formed of a single piece. Fan blade body 904 includes an airfoil shaped blade metallic or composite blade. Fan blade body 904 and metal leading edge 908 include a suction side 912 and a pressure side 914. Metal leading edge 908 is adhesively bonded to fan blade body 904 and wraps partially around fan blade body 904 in the direction of rotation of fan blade 900. Trailing edge 910 extends from fan blade body 904 in the opposite direction of rotation of fan blade 900.

Metal leading edge 908 includes a plurality of notches 916, a nose 918, a suction side bond edge 920, and a pressure side bond edge (not shown on FIG. 11). Suction side bond edge 920 and pressure side bond edge extend from nose 918 along fan blade body 904 in the opposite direction of rotation of fan blade 900. Each notches of the plurality of notches 916 a cut out extending from the edge of suction side bond edge 920 and pressure side bond edge toward nose 918. Each notch of the plurality of notches 916 is sized to break during extreme loading conditions, such as a fan blade out event, reducing the damage to fan case 549.

Figure 12:
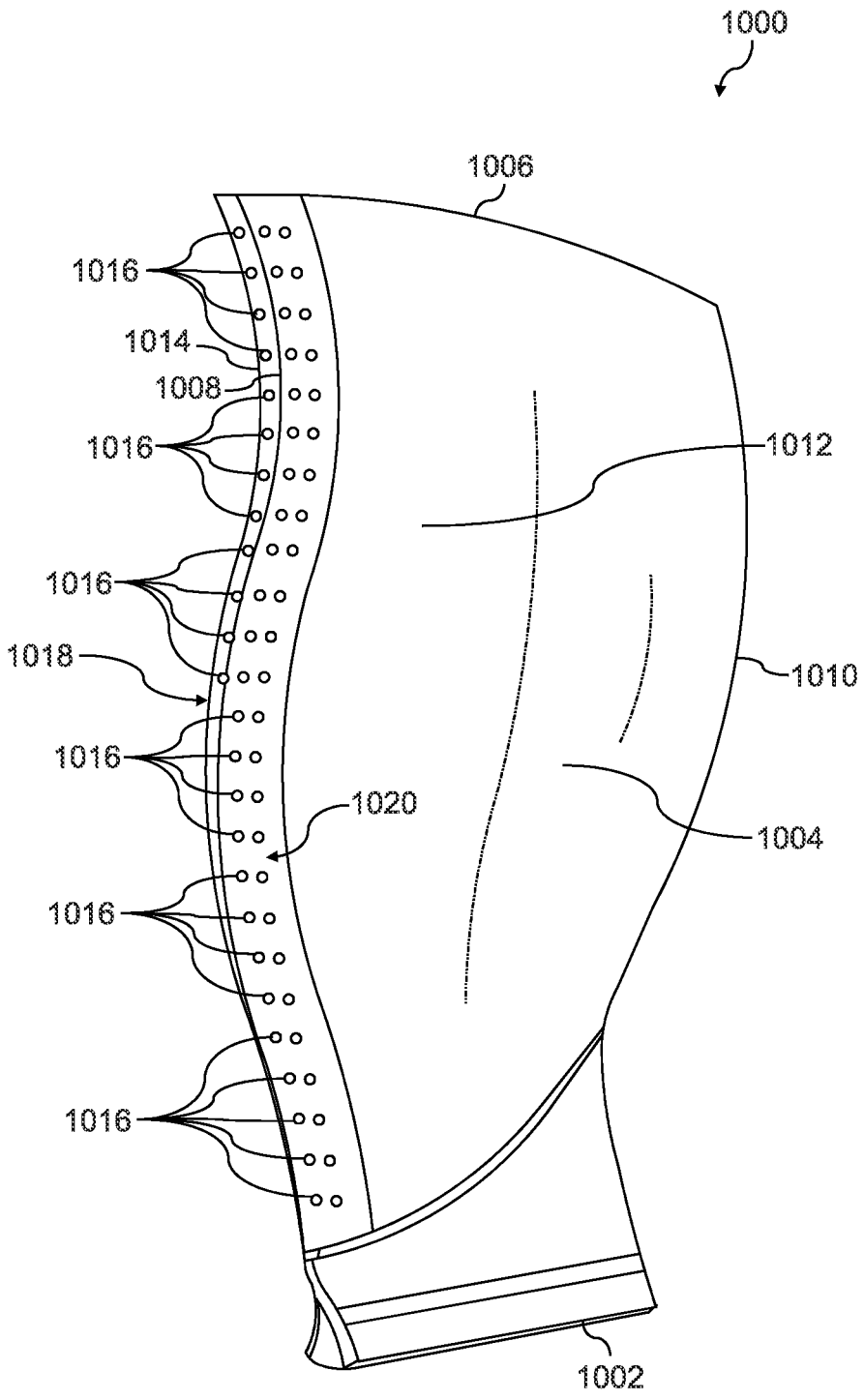
FIG. 12 is a perspective view of a metal leading edge with holes.

FIG. 12 is a perspective view of a fan blade 1000 with holes. Fan blade 1000 includes a fan blade root 1002, a fan blade body 1004, a fan blade tip 1006, a metal leading edge 1008, and a trailing edge 1010. Fan blade body 1004 extends from fan blade root 1002 in radial direction R to fan blade tip 1006. Fan blade body 1004 includes an airfoil shaped blade metallic or composite blade. Fan blade body 1004 and metal leading edge 1008 include a suction side 1012 and a pressure side 1014. Metal leading edge 1008 is adhesively bonded to fan blade body 1004 and wraps partially around fan blade body 1004 in the direction of rotation of fan blade 1000. Trailing edge 1010 extends from fan blade body 1004 in the opposite direction of rotation of fan blade 1000.

Metal leading edge 1008 includes a plurality of holes 1016, a nose 1018, a suction side bond edge 1020, and a pressure side bond edge (not shown on FIG. 12). Suction side bond edge 1020 and pressure side bond edge extend from nose 1018 along fan blade body 1004 in the opposite direction of rotation of fan blade 1000. Plurality of holes 1016 are cut into suction side bond edge 1020 and pressure side bond edge and weaken metal leading edge 1008 such that it breaks during extreme loading conditions, such as a fan blade out event, reducing the damage to fan case 549.

Figure 13:
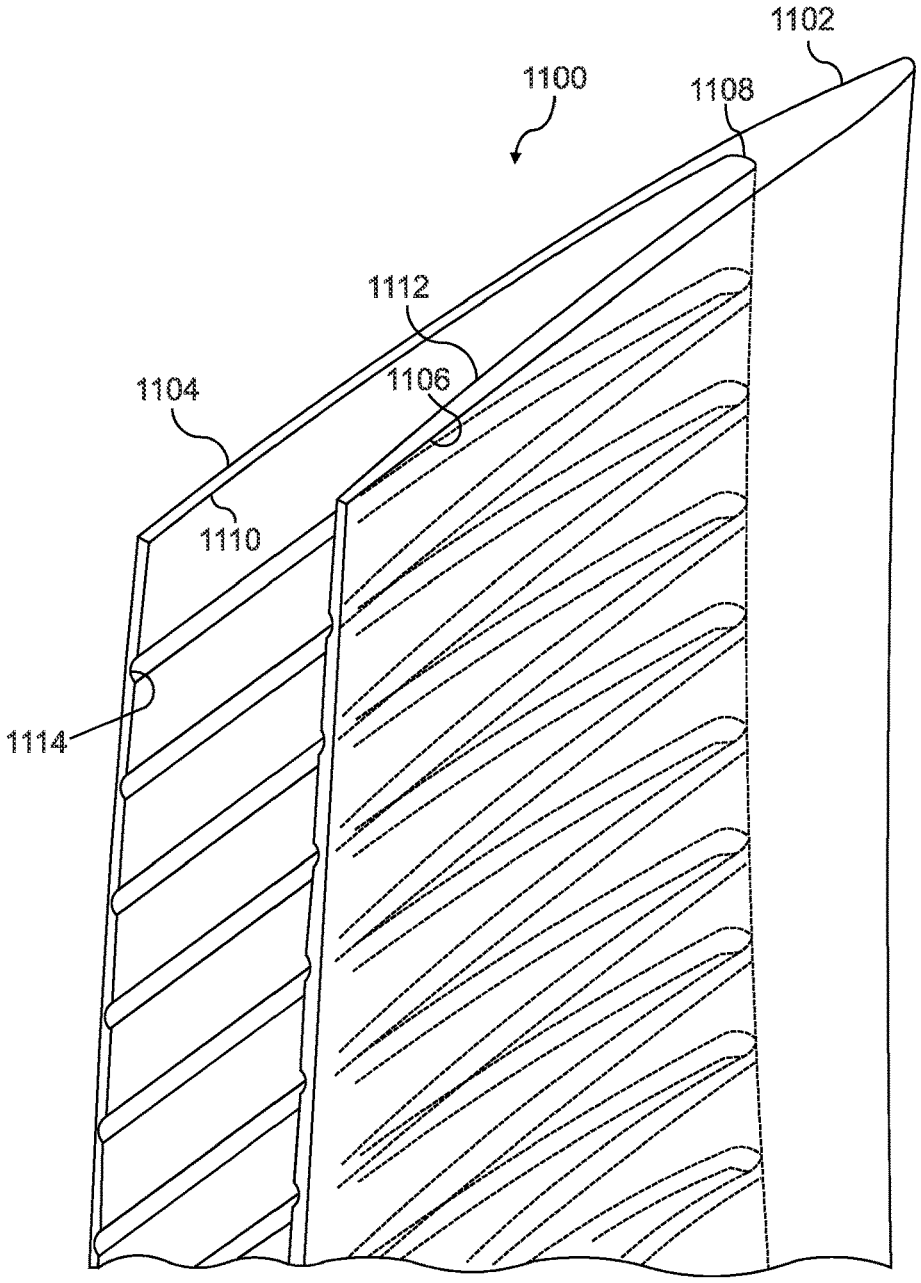
FIG. 13 is a perspective view of a metal leading edge with a weakened inner pressure and suction side bond edge.
Figure 14:
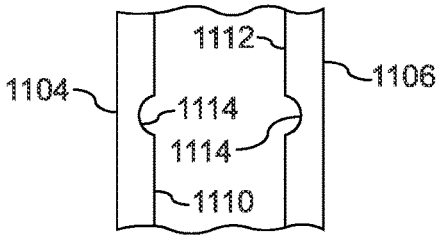
FIG. 14 is a partial end view of a metal leading edge with a weakened inner pressure and suction side bond edge.

FIG. 13 is a perspective view of a metal leading edge 1100 with a weakened inner pressure and suction side bond edge. FIG. 14 is a partial end view of metal leading edge 1100 with a weakened inner pressure and suction side bond edge. Metal leading edge 1100 includes a nose 1102, a pressure side bond edge 1104, and a suction side bond edge 1106. Nose 1102 extends from fan blade body 604 (shown in FIG. 8) in the direction of rotation of fan blade 600 (shown in FIG. 8). Pressure side bond edge 1104 and suction side bond edge 1106 extend from nose 1102 along fan blade body 604 in the opposite direction of rotation of fan blade 600. A non-fail-fused notch 1108 is formed from the conjunction of nose 1102, pressure side bond edge 1104, and suction side bond edge 1106. Pressure side bond edge 1104 includes a pressure side bond edge inner surface 1110 and suction side bond edge 1106 includes a suction side bond edge inner surface 1112. Metal leading edge 1100 includes a plurality of milled notches 1114 cut into pressure and suction side bond edge inner surfaces 1110 and 1112. Milled notches 1114 are milled into suction side bond edge inner surface 1112 and pressure side bond edge inner surface 1110 and weaken metal leading edge 1100 such that it breaks during extreme loading conditions, such as a fan blade out event, reducing the damage to fan case 549 (shown in FIG. 5).

This written description uses examples to disclose the present disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses:

A metal edge configured to engage a complementary leading edge of a composite blade member, said metal edge comprising: an elongate nose member comprising an outside edge, an inside notch and nose body extending therebetween a variable nose length, said inside notch comprising a plurality of fail-fuse elements spaced along a length of said inside notch, said nose length being less proximate said plurality of fail-fuse elements; a first integrally-formed edge portion extending away from said nose member along at least a portion of the length of said nose member; and a second portion edge extending away from said nose member along the at least a portion of the length of said nose member, said first edge portion and said second edge portion forming a notch at the conjunction of said first edge portion, said second edge portion, and said nose.

The metal edge of one or more of these clauses, wherein said nose length varies as a function of a radial distance along a length of said metal edge.

The metal edge of one or more of these clauses, wherein said nose length comprise a first length for a first radial distance from a fan blade root and said nose length reduces to a second length for a second radial distance from said fan blade root.

The metal edge of one or more of these clauses, wherein said nose length varies by a radial location according to a sinusoidal function.

The metal edge of one or more of these clauses, wherein said notch is configured to adhesively bond to a composite blade member.

The metal edge of one or more of these clauses, wherein said metal edge comprises titanium.

The metal edge of one or more of these clauses, wherein said metal edge comprises steel.

A fan blade assembly comprising: a fan blade airfoil body comprising a length and a leading edge; and a metal edge comprising: an elongate nose member comprising an outside edge, an inside notch and nose body extending therebetween a variable nose length, said inside notch comprising a plurality of fail-fuse elements spaced along a length of said inside notch, said nose length being less proximate said plurality of fail-fuse elements; a first integrally-formed edge portion extending away from said nose member along at least a portion of the length of said nose member; and a second portion edge extending away from said nose member along the at least a portion of the length of said nose member, said first edge portion and said second edge portion forming a notch at the conjunction of said first edge portion, said second edge portion, and said nose.

The fan blade assembly of one or more of these clauses, wherein said plurality of fail-fuse elements comprise a plurality of slits, said slits comprise a plurality of cutaway sections of said first edge portion and said second edge portion.

The fan blade assembly of one or more of these clauses, wherein said plurality of cutaway sections comprises rectangular cutaway sections.

The fan blade assembly of one or more of these clauses, wherein said plurality of fail-fuse elements comprise a plurality of holes within said first edge portion and said second edge portion.

The fan blade assembly of one or more of these clauses, wherein said metal leading edge comprises titanium.

The fan blade assembly of one or more of these clauses, wherein said metal leading edge comprises steel.

A fan blade comprising: a fan blade root, a fan blade tip, and an airfoil body extending axially therebetween, said airfoil body comprises an axially-spaced leading edge and an axially-spaced trailing edge, said airfoil body comprises a length extending between said fan blade root and said fan blade tip; a metal edge comprising: an elongate nose member comprising an outside edge, an inside notch and nose body extending therebetween a variable nose length, said inside notch comprising a plurality of fail-fuse elements spaced along a length of said inside notch, said nose length being less proximate said plurality of fail-fuse elements; a first integrally-formed edge portion extending away from said nose member along at least a portion of the length of said nose member; and a second portion edge extending away from said nose member along the at least a portion of the length of said nose member, said first edge portion and said second edge portion forming a notch at the conjunction of said first edge portion, said second edge portion, and said nose.

The fan blade of one or more of these clauses, wherein said nose length varies as a function of a radial distance along said length of said airfoil body.

The fan blade of one or more of these clauses, wherein said nose length comprise a first length for a first radial distance along said length of said airfoil body and said nose length reduces to a second length for a second radial distance along said length of said airfoil body.

The fan blade of one or more of these clauses, wherein said nose length varies by radial location along said length of said airfoil body according to a sinusoidal function.

The fan blade of one or more of these clauses, wherein said notch configured to adhesively bond to said axially-spaced leading edge of said airfoil body.

The fan blade of one or more of these clauses, wherein said metal edge comprises titanium.

The fan blade of one or more of these clauses, wherein said metal edge comprises steel.

A turbomachine for an aircraft, comprising: an annular casing; and a fan disposed inside the annular casing and mounted for rotation about an axial centerline, the fan including fan blades that extend radially outwardly toward the annular casing; wherein the fan includes an average fan chord width of the fan blades ("c"), a diameter of the fan ("D"), a fan pressure ratio ("FPR"), and a redline corrected fan tip speed ("$U_{c(tip)}$"), according to a First Performance Factor; wherein $FPF=[c/D]/[\sqrt{FPR-1}/U_{c(tip)}]$; and wherein $0.24*U_{c(tip)}+489>FPF>0.24*U_{c(tip)}-12+dy_1$ and wherein $0<dy_1<500$.

The turbomachine of one or more of these clauses wherein ratio c/D is within a range equal to or greater than 0.1 and equal to or less than 0.3.

The turbomachine of one or more of these clauses wherein ratio c/D is within a range equal to or greater than 0.15 and equal to or less than 0.21.

The turbomachine of one or more of these clauses wherein ratio c/D is equal to or greater than 0.1.

The turbomachine of one or more of these clauses wherein ratio c/D is equal to or less than 0.3.

The turbomachine of one or more of these clauses wherein FPR is within a range equal to or greater than 1.2 and equal to or less than 1.5.

The turbomachine of one or more of these clauses wherein FPR is within a range equal to or greater than 1.3 and equal to or less than 1.45.

The turbomachine of one or more of these clauses wherein FPR is equal to or greater than 1.2.

The turbomachine of one or more of these clauses wherein FPR is equal to or greater than 1.3.

The turbomachine of one or more of these clauses wherein FPR is equal to or less than 1.5.

The turbomachine of one or more of these clauses wherein FPR is equal to or less than 1.45.

The turbomachine of one or more of these clauses wherein $U_{c(tip)}$ is within a range equal to or greater than 500 ft/sec and equal to or less than 1,500 ft/sec.

The turbomachine of one or more of these clauses wherein $U_{c(tip)}$ is within a range equal to or greater than 500 ft/sec and equal to or less than 1,250 ft/sec.

The turbomachine of one or more of these clauses wherein $dy_1$ is equal to or greater than 7.5 and equal to or less than 500.

A turbomachine for an aircraft, comprising: an annular casing; and a fan disposed inside the annular casing and mounted for rotation about an axial centerline, the fan including fan blades that extend radially outwardly toward the annular casing; wherein the fan includes an average fan chord width of the fan blades ("c"), a diameter of the fan ("D"), a fan pressure ratio ("FPR"), and a redline corrected fan tip Mach number ("$M_{tip,c}^{(RL)}$"), according to a First Performance Factor; wherein $$FPF = \left[\frac{c}{0.15 \cdot D}\right] \Big/ \left[\left[\frac{\sqrt{FPR-1}}{\sqrt{0.4}}\right] \Big/ M_{tip,c}^{(RL)}\right] - 1.23,$$

and wherein $$m_1 \cdot \left[M_{tip,c}^{(RL)} - 1.1\right] + 6 > FPF > m_1 \cdot \left[M_{tip,c}^{(RL)} - 1.1\right] + \Delta y_1,$$

and wherein $0<\Delta y_1<6$.

The turbomachine of one or more of these clauses wherein $M_{tip,c}^{(RL)}$ is within a range equal to or greater than 0.45 and equal to or less than 1.34.

The turbomachine of one or more of these clauses wherein $M_{tip,c}^{(RL)}$ is within a range equal to or greater than 0.45 and equal to or less than 1.12.

The turbomachine of one or more of these clauses wherein $m_1$ is equal to 0.87 when $M_{tip,c}^{(RL)}$ is greater than or equal to 1.1.

The turbomachine of one or more of these clauses wherein $m_1$ is equal to 1.0 when $M_{tip,c}^{(RL)}$ is greater than or equal to 1.1.

The turbomachine of one or more of these clauses wherein $m_1$ is equal to 2.5 when $M_{tip,c}^{(RL)}$ is less than 1.1.

The turbomachine of one or more of these clauses wherein $m_1$ is equal to 3.34 when $M_{tip,c}^{(RL)}$ is less than 1.1.

The turbomachine of one or more of these clauses wherein $\Delta y_1$ is equal to or greater than 0.0125 and less than 6.

The turbomachine of one or more of these clauses wherein $\Delta y_1$ is equal to or greater than 0.04 and less than 6.

The turbomachine of one or more of these clauses wherein $\Delta y_1$ is equal to or greater than 0.07 and less than 6.

The turbomachine of one or more of these clauses wherein $\Delta y_1$ is equal to or greater than 0.1 and less than 6.

The turbomachine of one or more of these clauses wherein $\Delta y_1$ is equal to or greater than 0.2 and less than 6.

The turbomachine of one or more of these clauses wherein the turbomachine has a gear ratio within a range equal to or greater than 3.2 and equal to or less than 5.0.

The turbomachine of one or more of these clauses wherein the fan blade includes an airfoil portion made from a polymer matrix composite (PMC) material, a metallic leading edge, the ratio c/D is between 0.16 and 0.21, and the fan has between 16 and 25 fan blades.

The turbomachine of one or more of these clauses wherein ratio c/D is within a range equal to or greater than 0.1 and equal to or less than 0.3.

The turbomachine of one or more of these clauses wherein ratio c/D is within a range equal to or greater than 0.15 and equal to or less than 0.21.

The turbomachine of one or more of these clauses wherein ratio c/D is equal to or greater than 0.1.

The turbomachine of one or more of these clauses wherein ratio c/D is equal to or less than 0.3.

The turbomachine of one or more of these clauses wherein FPR is within a range equal to or greater than 1.2 and equal to or less than 1.5.

The turbomachine of one or more of these clauses wherein FPR is within a range equal to or greater than 1.3 and equal to or less than 1.45.

The turbomachine of one or more of these clauses wherein FPR is equal to or greater than 1.2.

The turbomachine of one or more of these clauses wherein FPR is equal to or greater than 1.3.

The turbomachine of one or more of these clauses wherein FPR is equal to or less than 1.5.

The turbomachine of one or more of these clauses wherein FPR is equal to or less than 1.45.

The turbomachine of one or more of these clauses wherein $U_{c(tip)}$ is within a range equal to or greater than 500 ft/sec and equal to or less than 1,500 ft/sec.

The turbomachine of one or more of these clauses wherein $U_{c(tip)}$ is within a range equal to or greater than 500 ft/sec and equal to or less than 1,250 ft/sec.

A turbomachine comprising: an annular casing; and a fan disposed inside the annular casing and mounted for rotation about an axial centerline, the fan including fan blades that extend radially outwardly toward the annular casing; wherein the fan includes a fan hub-to-tip ratio ("HTR"), a fan blade count ("BC"), a fan pressure ratio ("FPR"), and a redline corrected redline fan tip Mach number ("$M_{tip,c}^{(RL)}$") according to a Second Performance Factor ("SPF"), $$SPF = \sqrt{\frac{n}{4}(1 - HTR^2)/\left(\frac{BC}{20}\right)}/\left(\frac{\sqrt{FPR - 1}}{\sqrt{0.4}}\right)/M_{tip,c}^{(RL)} - 0.97,$$

-continued $$\text{wherein } m_2 \cdot \left[M_{tip,c}^{(RL)} - 1.1\right] + 1.5 > SPF > m_2 \cdot \left[M_{tip,c}^{(RL)} - 1.1\right] + \Delta y_2,$$

and wherein $0 < \Delta y_2 < 1.5$.

The turbomachine of one or more of these clauses wherein $\Delta y_2$ is equal to or greater than 0.0075 and less than 1.5.

The turbomachine of one or more of these clauses wherein $\Delta y_2$ is equal to or greater than 0.01 and less than 1.5.

The turbomachine of one or more of these clauses wherein $\Delta y_2$ is equal to or greater than 0.02 and less than 1.5.

The turbomachine of one or more of these clauses wherein $\Delta y_2$ is equal to or greater than 0.024 and less than 1.5.

The turbomachine of one or more of these clauses wherein $\Delta y_2$ is equal to or greater than 0.037 and less than 1.5.

The turbomachine of one or more of these clauses wherein $\Delta y_2$ is equal to or greater than 0.04 and less than 1.5.

The turbomachine of one or more of these clauses wherein $\Delta y_2$ is equal to or greater than 0.06 and less than 1.5.

The turbomachine of one or more of these clauses wherein $m_2$ is equal to 0.41 when $M_{tip,c}^{(RL)}$ is greater than or equal to 1.1.

The turbomachine of one or more of these clauses wherein $m_2$ is equal to 0.55 when $M_{tip,c}^{(RL)}$ is less than 1.1.

The turbomachine of one or more of these clauses wherein HTR is within a range equal to or greater than 0.1 and equal to or less than 0.5.

The turbomachine of one or more of these clauses wherein HTR is within a range equal to or greater than 0.2 and equal to or less than 0.275.

The turbomachine of one or more of these clauses wherein HTR is within a range equal to or greater than 0.2 and equal to or less than 0.25.

The turbomachine of one or more of these clauses wherein HTR is equal to or greater than 0.1.

The turbomachine of one or more of these clauses wherein HTR is equal to or less than 0.5.

The turbomachine of one or more of these clauses wherein BC is within a range equal to or greater than 10 and equal to or less than 18.

The turbomachine of one or more of these clauses wherein FPR is within a range equal to or greater than 1.2 and equal to or less than 1.5.

The turbomachine of one or more of these clauses wherein FPR is within a range equal to or greater than 1.3 and equal to or less than 1.45.

A method of assembly, comprising: mounting a fan inside an annular casing for rotation about an axial centerline, the fan including fan blades that extend radially outwardly toward the annular casing; wherein the fan includes an average fan chord width of the fan blades ("c"), a diameter of the fan ("D"), a fan pressure ratio ("FPR"), and a redline corrected fan tip redline Mach number ("$M_{tip,c}^{(RL)}$"), according to a First Performance Factor ("FPF"), wherein:

$$FPF = \left[\frac{c}{0.15 \cdot D}\right] \Big/ \left[\left[\frac{\sqrt{FPR - 1}}{\sqrt{0.4}}\right] \Big/ M_{tip,c}^{(RL)}\right] - 1.23;$$

-continued $$m_1 \cdot \left[M_{tip,c}^{(RL)} - 1.1\right] + 6 > FPF > m_1 \cdot \left[M_{tip,c}^{(RL)} - 1.1\right] + \Delta y_1;$$

and $$0 < \Delta y_1 < 6;$$

or wherein the fan includes a fan hub-to-tip ratio ("HTR"), a fan blade count ("BC"), FPR, and $M_{tip,c}^{(RL)}$ according to a Second Performance Factor ("SPF"), wherein:

$$SPF = \sqrt{\frac{\pi}{4}(1 - HTR^2) \Big/ \left(\frac{BC}{20}\right)} \Big/ \left(\frac{\sqrt{FPR - 1}}{\sqrt{0.4}}\right) \Big/ M_{tip,c}^{(RL)} - 0.97;$$

$$m_2 \cdot \left[M_{tip,c}^{(RL)} - 1.1\right] + 1.5 > SPF > m_2 \cdot \left[M_{tip,c}^{(RL)} - 1.1\right] + \Delta y_2;$$

and $$0 < \Delta y_2 < 1.5.$$

A turbomachine for an aircraft, comprising: an annular casing; and a fan disposed inside the annular casing and mounted for rotation about an axial centerline, the fan including fan blades that extend radially outwardly toward the annular casing; wherein the fan includes an average fan chord width of the fan blades ("c"), a diameter of the fan ("D"), a fan pressure ratio ("FPR"), and a redline corrected fan tip Mach number ("$M_{tip,c}^{(RL)}$"), according to a First Performance Factor; wherein $$FPF = \left[\frac{c}{0.15 \cdot D}\right] \Big/ \left[\left[\frac{\sqrt{FPR - 1}}{\sqrt{0.4}}\right] \Big/ M_{tip,c}^{(RL)}\right] - 1.23,$$

and wherein $m_1 \cdot [M_{tip,c}^{(RL)} - 1.1] + 9.14 > FPF > m_2 \cdot [M_{tip,c}^{(RL)} - 1.1]$, wherein $m_1$ is equal to 9.43 when $M_{tip,c}^{(RL)}$ is greater than or equal to 1.1 and is equal to 27.02 when $M_{tip,c}^{(RL)}$ is less than 1.1, and wherein $m_2$ is equal to 0.87 when $M_{tip,c}^{(RL)}$ is greater than or equal to 1.1 and is equal to 3.34 when $M_{tip,c}^{(RL)}$ is less than 1.1.

The turbomachine of one or more of these clauses wherein FPF is within a range equal to or greater than −0.8 and equal to or less than 8.4.

The turbomachine of one or more of these clauses wherein FPF is within a range equal to or greater than 0 and equal to or less than 6.

The turbomachine of one or more of these clauses wherein FPF is within a range equal to or greater than 1 and equal to or less than 2.

The turbomachine of one or more of these clauses wherein $M_{tip,c}^{(RL)}$ is within a range equal to or greater than 0.8 and equal to or less than 1.5.

The turbomachine of one or more of these clauses wherein $M_{tip,c}^{(RL)}$ is within a range equal to or greater than 0.9 and equal to or less than 1.4.

The turbomachine of one or more of these clauses wherein ratio c/D is within a range equal to or greater than 0.1 and equal to or less than 0.3.

The turbomachine of one or more of these clauses wherein FPR is within a range equal to or greater than 1.2 and equal to or less than 1.6.

The turbomachine of one or more of these clauses wherein FPR is within a range equal to or greater than 1.3 and equal to or less than 1.5.

The turbomachine of one or more of these clauses wherein FPR is within a range equal to or greater than 1.35 and equal to or less than 1.45.

The turbomachine of one or more of these clauses wherein the turbomachine has a gear ratio within a range equal to or greater than 3.2 and equal to or less than 5.0.

The turbomachine of one or more of these clauses wherein the fan blade includes an airfoil portion made from a polymer matrix composite (PMC) material, a metallic leading edge, the ratio c/D is between 0.16 and 0.21, and the fan has between 16 and 25 fan blades.

A turbomachine comprising: an annular casing; and a fan disposed inside the annular casing and mounted for rotation about an axial centerline, the fan including fan blades that extend radially outwardly toward the annular casing; wherein the fan includes a fan hub-to-tip ratio ("HTR"), a fan blade count ("BC"), a fan pressure ratio ("FPR"), and a redline corrected redline fan tip Mach number ("$M_{tip,c}^{(RL)}$"), according to a Second Performance Factor ("SPF"), $$SPF = SPF = \sqrt{\frac{\pi}{4}(1 - HTR^2) \Big/ \left(\frac{BC}{20}\right)} \Big/ \left(\frac{\sqrt{FPR - 1}}{\sqrt{0.4}}\right) \Big/ M_{tip,c}^{(RL)} - 0.97,$$

wherein $$m_3 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $M_{tip,c}^{(RL)}$ is greater than or equal to 1.1 and is equal to 0.55 when $M_{tip,c}^{(RL)}$ is less than 1.1.

The turbomachine of one or more of these clauses wherein SPF is within a range equal to or greater than 0.087 and equal to or less than 2.4.

The turbomachine of one or more of these clauses wherein SPF is within a range equal to or greater than 1 and equal to or less than 2.

A turbomachine for an aircraft comprising: an annular casing; and a fan disposed inside the annular casing and mounted for rotation about an axial centerline, the fan including fan blades that extend radially outwardly toward the annular casing, the fan blades including a first fan blade having a fan blade airfoil body and a metal edge, the fan blade airfoil body having a leading edge, the metal edge located at the leading edge and having a plurality of fail-fuse elements; wherein the fan includes an average fan chord width of the fan blades ("c"), a diameter of the fan ("D"), a fan pressure ratio ("FPR"), and a redline corrected fan tip Mach number ("$M_{tip,c}^{(RL)}$"), according to a First Performance Factor ("FPF"), wherein $$FPF = \left[\frac{c}{0.15 \cdot D}\right] \Big/ \left[\left[\frac{\sqrt{FPR - 1}}{\sqrt{0.4}}\right] \Big/ M_{tip,c}^{(RL)}\right] - 1.23,$$

-continued wherein $$m_1 \cdot \left[M_{tip,c}^{(RL)} - 1.1\right] + 9.14 > FPF > m_2 \cdot \left[M_{tip,c}^{(RL)} - 1.1\right],$$

and wherein $m_1$ is equal to 9.43 when $M_{tip,c}^{(RL)}$ is greater than or equal to 1.1 and is equal to 27.02 when $M_{tip,c}^{(RL)}$ is less than 1.1, and wherein $m_2$ is equal to 0.87 when $M_{tip,c}^{(RL)}$ is greater than or equal to 1.1 and is equal to 3.34 when $M_{tip,c}^{(RL)}$ is less than 1.1.

The turbomachine of any preceding clause, wherein the metal edge further comprises an elongate nose member having an outside edge, an inside notch, and nose body extending therebetween a variable nose length, said inside notch comprising the plurality of fail-fuse elements spaced along a length of said inside notch.

The turbomachine of any preceding clause, wherein the nose length is less proximate said plurality of fail-fuse elements.

The turbomachine of any preceding clause, wherein the metal edge further comprises a first integrally-formed edge portion extending away from said nose member along at least a portion of the length of said nose member, and a second portion edge extending away from said nose member along the at least a portion of the length of said nose member, said first edge portion and said second edge portion forming a notch at the conjunction of said first edge portion, said second edge portion, and said nose.

The turbomachine of any preceding clause, wherein said plurality of fail-fuse elements comprise a plurality of slits, said slits comprise a plurality of cutaway sections of said first edge portion and said second edge portion.

The turbomachine of any preceding clause, wherein said plurality of cutaway sections comprises rectangular cutaway sections.

The turbomachine of any preceding clause, wherein said metal leading edge comprises titanium.

The turbomachine of any preceding clause, wherein said metal leading edge comprises steel.

The turbomachine of any preceding clause, wherein said nose length varies as a function of a radial distance along a length of said metal edge.

The turbomachine of any preceding clause, wherein said nose length comprise a first length for a first radial distance from a fan blade root and said nose length reduces to a second length for a second radial distance from said fan blade root.

The turbomachine of any preceding clause, wherein said nose length varies by a radial location according to a sinusoidal function.

The turbomachine of any preceding clause, wherein said notch is configured to adhesively bond to a composite blade member.

The turbomachine of any preceding clause, wherein FPF is within a range equal to or greater than −0.8 and equal to or less than 8.4.

The turbomachine of any preceding clause, wherein FPF is within a range equal to or greater than 0 and equal to or less than 6.

The turbomachine of any preceding clause, wherein FPF is within a range equal to or greater than 1 and equal to or less than 2.

The turbomachine of any preceding clause, wherein $M_{tip,c}^{(RL)}$ is within a range equal to or greater than 0.8 and equal to or less than 1.5.

The turbomachine of any preceding clause, wherein $M_{tip,c}^{(RL)}$ is within a range equal to or greater than 0.9 and equal to or less than 1.4.

The turbomachine of any preceding clause, wherein ratio c/D is within a range equal to or greater than 0.1 and equal to or less than 0.3.

The turbomachine of any preceding clause, wherein FPR is within a range equal to or greater than 1.2 and equal to or less than 1.6.

The turbomachine of any preceding clause, wherein FPR is within a range equal to or greater than 1.3 and equal to or less than 1.5.

The turbomachine of any preceding clause, wherein FPR is within a range equal to or greater than 1.35 and equal to or less than 1.45.

The turbomachine of any preceding clause, wherein the turbomachine has a gear ratio within a range equal to or greater than 3.2 and equal to or less than 5.0.

The turbomachine of any preceding clause, wherein the fan blade includes an airfoil portion made from a polymer matrix composite (PMC) material, a metallic leading edge, the ratio c/D is between 0.16 and 0.21, and the fan has between 16 and 25 fan blades.

A turbomachine comprising: an annular casing; and a fan disposed inside the annular casing and mounted for rotation about an axial centerline, the fan including fan blades that extend radially outwardly toward the annular casing, the fan blades including a first fan blade having a fan blade airfoil body and a metal edge, the fan blade airfoil body having a leading edge, the metal edge located at the leading edge and having a plurality of fail-fuse elements; wherein the fan includes a fan hub-to-tip ratio ("HTR"), a fan blade count ("BC"), a fan pressure ratio ("FPR"), and a redline corrected fan tip Mach number ("$M_{tip,c}^{(RL)}$"), according to a Second Performance Factor ("SPF"), wherein $$SPF = \sqrt{\frac{\pi}{4}(1 - HTR^2) \Big/ \left(\frac{BC}{20}\right)} \Big/ \left(\frac{\sqrt{FPR - 1}}{\sqrt{0.4}}\right) \Big/ M_{tip,c}^{(RL)} - 0.97,$$

wherein $$m_3 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $M_{tip,c}^{(RL)}$ is greater than or equal to 1.1 and is equal to 0.55 when $M_{tip,c}^{(RL)}$ is less than 1.1.

The turbomachine of any preceding clause, wherein SPF is within a range equal to or greater than 0.087 and equal to or less than 2.4.

The turbomachine of any preceding clause, wherein SPF is within a range equal to or greater than 1 and equal to or less than 2.

The turbomachine of any preceding clause, wherein $M_{tip,c}^{(RL)}$ is within a range equal to or greater than 0.8 and equal to or less than 1.5.

The turbomachine of any preceding clause, wherein $M_{tip,c}^{(RL)}$ is within a range equal to or greater than 0.9 and equal to or less than 1.4.

The turbomachine of any preceding clause, wherein HTR is within a range equal to or greater than 0.2 and equal to or less than 0.4.

The turbomachine of any preceding clause, wherein HTR is within a range equal to or greater than 0.25 and equal to or less than 0.35.

The turbomachine of any preceding clause, wherein FPR is within a range equal to or greater than 1.2 and equal to or less than 1.6.

The turbomachine of any preceding clause, wherein FPR is within a range equal to or greater than 1.3 and equal to or less than 1.5.

The turbomachine of any preceding clause, wherein FPR is within a range equal to or greater than 1.35 and equal to or less than 1.45.

The turbomachine of any preceding clause, wherein BC is within a range equal to or greater than 3 and equal to or less than 18.

The turbomachine of any preceding clause, wherein BC is within a range equal to or greater than 10 and equal to or less than 16.

The turbomachine of any preceding clause, wherein the turbomachine has a gear ratio within a range equal to or greater than 3.2 and equal to or less than 5.0.

The turbomachine of any preceding clause, wherein the fan blade includes an airfoil portion made from a polymer matrix composite (PMC) material, a metallic leading edge, the ratio c/D is between 0.16 and 0.21, and the fan has between 16 and 25 fan blades.

A turbomachine for an aircraft comprising: an annular casing; and a fan disposed inside the annular casing and mounted for rotation about an axial centerline, the fan including fan blades that extend radially outwardly toward the annular casing, the fan blades including a first fan blade having a fan blade airfoil body and a metal edge, the fan blade airfoil body having a leading edge, the metal edge located at the leading edge and having a plurality of fail-fuse elements; wherein the fan includes an average fan chord width of the fan blades ("c"), a diameter of the fan ("D"), a fan pressure ratio ("FPR"), and a redline corrected fan tip Mach number ("$M_{tip,c}^{(RL)}$"), according to a First Performance Factor ("FPF"), wherein $$FPF = \left[\frac{c}{0.15 \cdot D}\right] \Big/ \left[\left[\frac{\sqrt{FPR-1}}{\sqrt{0.4}}\right] \Big/ M_{tip,c}^{(RL)}\right] - 1.23,$$

wherein $$m_1 \cdot \left[M_{tip,c}^{(RL)} - 1.1\right] + 9.14 > FPF > m_2 \cdot \left[M_{tip,c}^{(RL)} - 1.1\right],$$

and wherein $m_1$ is equal to 9.43 when $M_{tip,c}^{(RL)}$ is greater than or equal to 1.1 and is equal to 27.02 when $M_{tip,c}^{(RL)}$ is less than 1.1, and wherein $m_2$ is equal to 0.87 when $M_{tip,c}^{(RL)}$ is greater than or equal to 1.1 and is equal to 3.34 when $M_{tip,c}^{(RL)}$ is less than 1.1; wherein the fan includes a fan hub-to-tip ratio ("HTR"), a fan blade count ("BC"), the fan pressure ratio ("FPR"), and the redline corrected fan tip Mach number ("$M_{tip,c}^{(RL)}$"), according to a Second Performance Factor ("SPF"), wherein $$SPF = \sqrt{\frac{\pi}{4}(1 - HTR^2)} \Big/ \left(\frac{BC}{20}\right) \Big/ \left(\frac{\sqrt{FPR-1}}{\sqrt{0.4}}\right) \Big/ M_{tip,c}^{(RL)} - 0.97,$$

wherein $$m_3 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $M_{tip,c}^{(RL)}$ is greater than or equal to 1.1 and is equal to 0.55 when $M_{tip,c}^{(RL)}$ is less than 1.1.

The turbomachine of any preceding clause, wherein FPF is within a range equal to or greater than −0.8 and equal to or less than 8.4.

The turbomachine of any preceding clause, wherein FPF is within a range equal to or greater than 0 and equal to or less than 6.

The turbomachine of any preceding clause, wherein FPF is within a range equal to or greater than 1 and equal to or less than 2.

The turbomachine of any preceding clause, wherein SPF is within a range equal to or greater than 0.087 and equal to or less than 2.4.

The turbomachine of any preceding clause, wherein SPF is within a range equal to or greater than 1 and equal to or less than 2.

The turbomachine of any preceding clause, wherein $M_{tip,c}^{(RL)}$ is within a range equal to or greater than 0.8 and equal to or less than 1.5.

The turbomachine of any preceding clause, wherein $M_{tip,c}^{(RL)}$ is within a range equal to or greater than 0.9 and equal to or less than 1.4.

The turbomachine of any preceding clause, wherein ratio c/D is within a range equal to or greater than 0.1 and equal to or less than 0.3.

The turbomachine of any preceding clause, wherein HTR is within a range equal to or greater than 0.2 and equal to or less than 0.4.

The turbomachine of any preceding clause, wherein HTR is within a range equal to or greater than 0.25 and equal to or less than 0.35.

The turbomachine of any preceding clause, wherein FPR is within a range equal to or greater than 1.2 and equal to or less than 1.6.

The turbomachine of any preceding clause, wherein FPR is within a range equal to or greater than 1.3 and equal to or less than 1.5.

The turbomachine of any preceding clause, wherein FPR is within a range equal to or greater than 1.35 and equal to or less than 1.45.

The turbomachine of any preceding clause, wherein BC is within a range equal to or greater than 3 and equal to or less than 18.

The turbomachine of any preceding clause, wherein BC is within a range equal to or greater than 10 and equal to or less than 16.

The turbomachine of any preceding clause, wherein the turbomachine has a gear ratio within a range equal to or greater than 3.2 and equal to or less than 5.0.

The turbomachine of any preceding clause, wherein the fan blade includes an airfoil portion made from a polymer matrix composite (PMC) material, a metallic leading edge, the ratio c/D is between 0.16 and 0.21, and the fan has between 16 and 25 fan blades.

What is claimed is:

1. A turbomachine for an aircraft comprising:

an annular casing; and a fan disposed inside the annular casing and mounted for rotation about an axial centerline, the fan including fan blades that extend radially outwardly toward the annular casing, the fan blades including a first fan blade having a fan blade airfoil body and a metal edge, the fan blade airfoil body having a leading edge, the metal edge located at the leading edge and having a plurality of fail-fuse elements;

wherein the fan includes an average fan chord width of the fan blades ("c"), a diameter of the fan ("D"), a fan pressure ratio ("FPR"), and a redline corrected fan tip Mach number ("$M_{tip,c}^{(RL)}$"), according to a First Performance Factor ("FPF"), wherein $$FPF = \left[\frac{c}{0.15 \cdot D}\right] / \left[\left[\frac{\sqrt{FPR-1}}{\sqrt{0.4}}\right] / M_{tip,c}^{(RL)}\right] - 1.23,$$

$$\text{wherein } m_1 \cdot \left[M_{tip,c}^{(RL)} - 1.1\right] + 9.14 > FPF > m_2 \cdot \left[M_{tip,c}^{(RL)} - 1.1\right],$$

and wherein $m_1$ is equal to 9.43 when $M_{tip,c}^{(RL)}$ is greater than or equal to 1.1 and is equal to 27.02 when $M_{tip,c}^{(RL)}$ is less than 1.1, and wherein $m_2$ is equal to 0.87 when $M_{tip,c}^{(RL)}$ is greater than or equal to 1.1 and is equal to 3.34 when $M_{tip,c}^{(RL)}$ is less than 1.1.

2. The turbomachine of claim 1, wherein the metal edge further comprises an elongate nose member having an outside edge, an inside notch, and nose body extending therebetween a variable nose length, said inside notch comprising the plurality of fail-fuse elements spaced along a length of said inside notch.

3. The turbomachine of claim 2, wherein the nose length is less proximate said plurality of fail-fuse elements.

4. The turbomachine of claim 2, wherein the metal edge further comprises a first integrally-formed edge portion extending away from said nose member along at least a portion of the length of said nose member, and a second edge portion extending away from said nose member along at least a portion of the length of said nose member, said first edge portion and said second edge portion forming the inside notch at a conjunction of said first edge portion, said second edge portion, and said nose member.

5. The turbomachine of claim 4, wherein said plurality of fail-fuse elements comprise a plurality of slits, said slits comprise a plurality of cutaway sections of said first edge portion and said second edge portion.

6. The turbomachine of claim 5, wherein said plurality of cutaway sections comprises rectangular cutaway sections.

7. The turbomachine of claim 2, wherein said metal edge comprises titanium.

8. The turbomachine of claim 2, wherein said metal edge comprises steel.

9. The turbomachine of claim 2, wherein said nose length varies as a function of a radial distance along a length of said metal edge.

10. The turbomachine of claim 2, wherein said nose length comprises a first length for a first radial distance from a fan blade root and said nose length reduces to a second length for a second radial distance from said fan blade root.

11. The turbomachine of claim 2, wherein said nose length varies by a radial location according to a sinusoidal function.

12. The turbomachine of claim 2, further comprising a composite blade member as at least one of the fan blades and wherein said notch is configured to adhesively bond to the composite blade member.

13. The turbomachine of claim 1, wherein:

FPF is within a range equal to or greater than −0.8 and equal to or less than 8.4;

$M_{tip,c}^{(RL)}$ is within a range equal to or greater than 0.8 and equal to or less than 1.5;

a ratio c/D is within a range equal to or greater than 0.1 and equal to or less than 0.3; and FPR is within a range equal to or greater than 1.2 and equal to or less than 1.6.

14. The turbomachine of claim 1, wherein:

the turbomachine has a gear ratio within a range equal to or greater than 3.2 and equal to or less than 5.0; and the fan blade includes an airfoil portion made from a polymer matrix composite (PMC) material, a ratio c/D is between 0.16 and 0.21, and the fan has between 16 and 25 fan blades.

15. A turbomachine comprising:

an annular casing; and a fan disposed inside the annular casing and mounted for rotation about an axial centerline, the fan including fan blades that extend radially outwardly toward the annular casing, the fan blades including a first fan blade having a fan blade airfoil body and a metal edge, the fan blade airfoil body having a leading edge, the metal edge located at the leading edge and having a plurality of fail-fuse elements;

wherein the fan includes a fan hub-to-tip ratio ("HTR"), a fan blade count ("BC"), a fan pressure ratio ("FPR"), and a redline corrected fan tip Mach number ("$M_{tip,c}^{(RL)}$") according to a Second Performance Factor ("SPF"), wherein $$SPF = \sqrt{\frac{\pi}{4}(1 - HTR^2) / \left(\frac{BC}{20}\right)} / \left(\frac{\sqrt{FPR-1}}{\sqrt{0.4}}\right) / M_{tip,c}^{(RL)} - 0.97,$$

$$\text{wherein } m_3 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $M_{tip,c}^{(RL)}$ is greater than or equal to 1.1 and is equal to 0.55 when $M_{tip,c}^{(RL)}$ is less than 1.1.

16. The turbomachine of claim 15, wherein:

SPF is within a range equal to or greater than 0.087 and equal to or less than 2.4;

$M_{tip,c}^{(RL)}$ is within a range equal to or greater than 0.8 and equal to or less than 1.5;

HTR is within a range equal to or greater than 0.2 and equal to or less than 0.4;

FPR is within a range equal to or greater than 1.2 and equal to or less than 1.6; and BC is within a range equal to or greater than 3 and equal to or less than 18.

17. The turbomachine of claim 15, wherein:

the turbomachine has a gear ratio within a range equal to or greater than 3.2 and equal to or less than 5.0; and the fan blade includes an airfoil portion made from a polymer matrix composite (PMC) material, a metallic leading edge, a ratio c/D is between 0.16 and 0.21, and the fan has between 16 and 25 fan blades.

18. A turbomachine for an aircraft comprising:

an annular casing; and a fan disposed inside the annular casing and mounted for rotation about an axial centerline, the fan including fan blades that extend radially outwardly toward the annular casing, the fan blades including a first fan blade having a fan blade airfoil body and a metal edge, the fan blade airfoil body having a leading edge, the metal edge located at the leading edge and having a plurality of fail-fuse elements;

wherein the fan includes an average fan chord width of the fan blades ("c"), a diameter of the fan ("D"), a fan pressure ratio ("FPR"), and a redline corrected fan tip Mach number ("$M_{tip,c}^{(RL)}$") according to a First Performance Factor ("FPF"), wherein $$FPF = \left[\frac{c}{0.15 \cdot D}\right] / \left[\left[\frac{\sqrt{FPR-1}}{\sqrt{0.4}}\right] / M_{tip,c}^{(RL)}\right] - 1.23,$$

$$\text{wherein } m_1 \cdot \left[M_{tip,c}^{(RL)} - 1.1\right] + 9.14 > FPF > m_2 \cdot \left[M_{tip,c}^{(RL)} - 1.1\right],$$

and wherein $m_1$ is equal to 9.43 when $M_{tip,c}^{(RL)}$ is greater than or equal to 1.1 and is equal to 27.02 when $M_{tip,c}^{(RL)}$ is less than 1.1, and wherein $m_2$ is equal to 0.87 when $M_{tip,c}^{(RL)}$ is greater than or equal to 1.1 and is equal to 3.34 when $M_{tip,c}^{(RL)}$ is less than 1.1;

wherein the fan includes a fan hub-to-tip ratio ("HTR"), a fan blade count ("BC"), the fan pressure ratio ("FPR"), and the redline corrected fan tip Mach number ("$M_{tip,c}^{(RL)}$") according to a Second Performance Factor ("SPF"), wherein $$SPF = \sqrt{\frac{\pi}{4}(1 - HTR^2) / \left(\frac{BC}{20}\right) / \left(\frac{\sqrt{FPR-1}}{\sqrt{0.4}}\right)} / M_{tip,c}^{(RL)} - 0.97,$$

$$\text{wherein } m_3 \cdot \left[M_{tip,c}^{(RL)} - 1.1\right] + 2.52 > SPF > m_4 \cdot \left[M_{tip,c}^{(RL)} - 1.1\right]$$

wherein $m_3$ is equal to 3.17, and wherein $m_4$ is equal to 0.41 when $M_{tip,c}^{(RL)}$ is greater than or equal to 1.1 and is equal to 0.55 when $M_{tip,c}^{(RL)}$ is less than 1.1.

19. The turbomachine of claim 18, wherein:

FPF is within a range equal to or greater than −0.8 and equal to or less than 8.4;

SPF is within a range equal to or greater than 0.087 and equal to or less than 2.4;

$M_{tip,c}^{(RL)}$ is within a range equal to or greater than 0.8 and equal to or less than 1.5;

a ratio c/D is within a range equal to or greater than 0.1 and equal to or less than 0.3;

HTR is within a range equal to or greater than 0.2 and equal to or less than 0.4;

FPR is within a range equal to or greater than 1.2 and equal to or less than 1.6; and BC is within a range equal to or greater than 3 and equal to or less than 18.

20. The turbomachine of claim 18, wherein:

the turbomachine has a gear ratio within a range equal to or greater than 3.2 and equal to or less than 5.0; and the fan blade includes an airfoil portion made from a polymer matrix composite (PMC) material, a metallic leading edge, a ratio c/D is between 0.16 and 0.21, and the fan has between 16 and 25 fan blades.

* * * * *